US010525722B2

(12) United States Patent
Hirasawa et al.

(10) Patent No.: US 10,525,722 B2
(45) Date of Patent: Jan. 7, 2020

(54) LIQUID TANK

(71) Applicant: SEIKO EPSON CORPORATION, Tokyo (JP)

(72) Inventors: Yusuke Hirasawa, Matsumoto (JP); Takashi Koase, Shiojiri (JP); Shoma Kudo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/189,494

(22) Filed: Nov. 13, 2018

(65) Prior Publication Data

US 2019/0143707 A1 May 16, 2019

(30) Foreign Application Priority Data

Nov. 14, 2017 (JP) ..... 2017-218830

(51) Int. Cl.

| | |
|---|---|
| ***B41J 2/175*** | (2006.01) |
| *B41J 2/165* | (2006.01) |
| *B41J 2/155* | (2006.01) |
| *B05C 11/10* | (2006.01) |
| *B41J 2/185* | (2006.01) |

(52) U.S. Cl.

CPC ..... *B41J 2/17596* (2013.01); *B05C 11/10* (2013.01); *B41J 2/155* (2013.01); *B41J 2/16588* (2013.01); *B41J 2/185* (2013.01)

(58) Field of Classification Search

CPC .... B41J 2/155; B41J 2/16517; B41J 2/16588; B41J 2/175; B41J 2/17513; B41J 2/1752; B41J 2/17523; B41J 2/17553; B41J 2/17596; B41J 2/185; B41J 2/19; B41J 29/13; B05C 11/10

See application file for complete search history.

(56) References Cited

U.S. PATENT DOCUMENTS

| | | | | |
|---|---|---|---|---|
| 5,757,390 A * | 5/1998 | Gragg | ..... | B41J 2/175 347/7 |
| 5,812,168 A * | 9/1998 | Pawlowski, Jr. | ..... | B41J 2/175 347/85 |
| 6,733,114 B2 * | 5/2004 | Kobayashi | ..... | B41J 2/17503 347/85 |

(Continued)

FOREIGN PATENT DOCUMENTS

| | | |
|---|---|---|
| JP | 2008-201094 A | 9/2008 |
| JP | 2011-207189 A | 10/2011 |

*Primary Examiner* — Anh T Vo

(74) *Attorney, Agent, or Firm* — Foley & Lardner LLP

(57) ABSTRACT

Provided is a liquid tank in which air bubbles are less likely to remain in a valve mechanism provided in an on-carriage-type liquid tank. The liquid tank has a liquid supply portion, a first liquid chamber, a second liquid chamber that can contain the liquid to be supplied to the first liquid chamber, and a valve mechanism that is arranged between the first liquid chamber and the second liquid chamber, and the valve mechanism has, inside an exterior wall constituting the valve mechanism, a channel member, a biasing member, a valve body, and a rod from an upstream side of flow of the liquid in the stated order, the channel member is provided inside the biasing member, and includes a first channel in which the liquid can pass, and the exterior wall and the biasing member form a second channel through which the liquid can pass therebetween.

9 Claims, 14 Drawing Sheets

(56) References Cited

U.S. PATENT DOCUMENTS 6,799,840 B2 * 10/2004 Inamura ..... B41J 2/17509
347/85
8,141,992 B2 * 3/2012 Ishizawa ..... B41J 2/17513
347/85

* cited by examiner

LIQUID TANK

BACKGROUND

1. Technical Field

The present invention relates to a liquid tank.

2. Related Art

Conventionally, fluid ejection apparatuses having a valve unit in an ink supply channel thereof are known (see JP-A-2008-201094). The valve unit has a choke valve provided on the upstream side of the ink supply channel, and after the negative pressure has increased in the ink supply channel due to the choke valve being closed while filling the apparatus with ink, air bubbles can be discharged by opening the choke valve.

JP-A-2008-201094 is an example of related art.

However, there was an issue that the above-described valve unit cannot be provided in a so-called on-carriage-type liquid tank due to the valve unit having a complicated mechanism, and being relatively large-sized.

The invention aims to provide, in an on-carriage-type liquid tank, a liquid tank in which air bubbles are less likely to remain in a valve mechanism provided within the tank.

SUMMARY

The invention can be realized as the following modes or application examples.

Application Example 1

A liquid tank according to this application example is a liquid tank that is mounted in a carriage provided with a liquid ejection head, and has a liquid supply portion having a liquid supply port that receives a liquid introduction needle portion of the liquid ejection head, and to which the liquid introduction needle portion is detachably connected, a first liquid chamber that can contain the liquid to be supplied to the liquid supply portion, a second liquid chamber that is in communication with the first liquid chamber, and can contain the liquid to be supplied to the first liquid chamber, and a valve mechanism that is arranged between the first liquid chamber and the second liquid chamber, and the valve mechanism has, inside an exterior wall constituting the valve mechanism, a channel member, a biasing member, a valve body, and a rod from an upstream side of flow of the liquid in the stated order, the channel member is provided inside the biasing member, and includes a first channel through which the liquid can pass, and the exterior wall and the biasing member form a second channel through which the liquid can pass therebetween.

According to this configuration, it is possible to allow liquid to pass from the first channel and the second channel. In this case, by allowing liquid to pass at a lower flow speed in the first channel provided inside the biasing member, and allowing the liquid to pass from the second channel at a flow speed higher than the flow speed at which the liquid passes through the first channel, it is possible to discharge air bubbles from the second channel in which liquid flows at a higher flow speed to the liquid ejection head side while preventing air bubbles from attaching to the valve mechanism including the first channel. Accordingly, in an on-carriage-type liquid tank, it is possible to suppress attachment of air bubbles to the valve mechanism, and easily discharge air bubbles from the liquid ejection head.

Application Example 2

The liquid tank according to the above application example is configured such that a channel resistance of the second channel is lower than a channel resistance of the first channel.

According to this configuration, the flow speed of liquid in the second channel can be made higher than the flow speed of liquid in the first channel, and it is possible to efficiently discharge air bubbles to the liquid ejection head side.

Application Example 3

The second channel of the liquid tank according to the above application example is arranged downstream of the first channel.

According to this configuration, liquid passes through paths while, first, the first channel is filled with liquid whose flow speed is low, and next, the second channel provided downstream of the first channel is filled with liquid whose flow speed is higher. Accordingly, it is possible to discharge air bubbles from the second channel to the liquid ejection head side while preventing air bubbles from attaching to the valve mechanism in the vicinity of the first channel.

Application Example 4

In the liquid tank according to the above application example, in a usage state, the second channel is arranged above the first channel in a vertical direction.

According to this configuration, when the liquid tank is in a usage state, in other words, when the liquid tank is mounted in the carriage, the second channel is positioned above the first channel. Accordingly, air bubbles are likely to gather on the second channel side that is on the upper side in the vertical direction, and due to the high flow speed of liquid, it is possible to easily discharge air bubbles to the liquid ejection head side.

Application Example 5

In the liquid tank according to the above application example, at least a portion of the channel member has a shape that runs along an inner periphery of the biasing member.

According to this configuration, liquid flows through the channel member arranged along the inner periphery of the biasing member, and thus it is possible to reduce attachment of air bubbles to the biasing member.

Application Example 6

In the liquid tank according to the above application example, at least of a portion of the exterior wall that forms the second channel has a shape that runs along an outer periphery of the biasing member.

According to this configuration, it is possible to prevent air bubbles from gathering in the second channel. It is also possible to allow liquid to flow efficiently while preventing air bubbles from attaching or remaining in the second channel.

Application Example 7

In the liquid tank according to the above application example, at least of a portion of the channel member that receives one end of the biasing member is made of a film.

According to this configuration, it is possible to reliably define the first channel, the second channel, and the like.

Application Example 8

In the liquid tank according to the above application example, in a wall portion that encloses the valve body in a usage state, a communication portion through which the liquid can pass is provided on an upper side in the vertical direction.

According to this configuration, it is possible to secure a path of liquid while filling a gap in the periphery of the valve mechanism by forming a wall portion such that air bubbles do not remain in the vicinity of the valve mechanism.

Application Example 9

The liquid tank according to the above application example further includes a pressure receiving plate capable of abutting against one end of the rod with the valve body provided at the other end thereof, a first film that covers the pressure receiving plate so as to be capable of abutting against the pressure receiving plate, and a tank cover that covers the pressure receiving plate so as to be capable of abutting against the first film.

According to this configuration, the tank cover restricts deformation of the first film in one direction. Accordingly, it is possible to prevent a change in the working pressure due to thermal expansion of the first film and the like. In addition, it is possible to prevent separation of a welding portion of the first film and liquid leakage.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

A-1. Configuration of Liquid Ejection Apparatus

Figure 1:
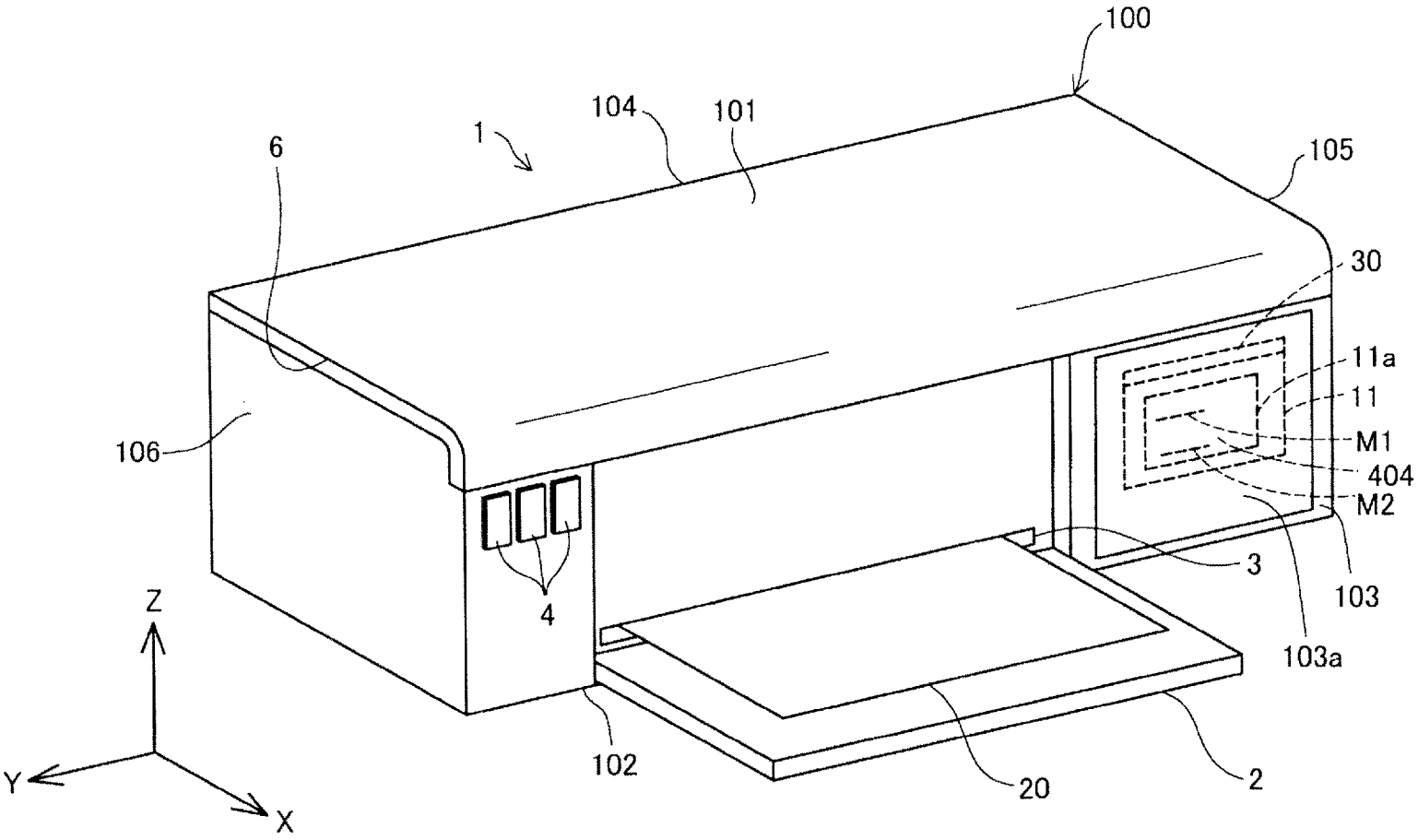
FIG. 1 is an external view of a liquid ejection apparatus that has a liquid tank as a mode of the invention.

FIG. 1 is an external view of a liquid ejection apparatus 1 that has a liquid tank as a mode of the invention. FIG. 1 shows three spatial axes orthogonal to each other, namely, an X axis, a Y axis, and a Z axis. A direction along the X axis is referred to as an "X axis direction", a direction along the Y axis is referred to as a "Y axis direction", and a direction along the Z axis is referred to as a "Z axis direction" (an up-down direction). The liquid ejection apparatus 1 is installed on a plane parallel to the X axis direction and the Y axis direction (an XY plane). A −Z axis direction is the vertical downward direction, and a +Z axis direction is the vertical upward direction. Also in other drawings to be described below, the X axis, Y axis, and Z axis are added as necessary.

The liquid ejection apparatus 1 is a so-called inkjet printer, and prints on a recording medium such as paper by ejecting ink as a liquid onto the recording medium. The liquid ejection apparatus 1 of this embodiment is a printer that performs monochrome printing using black ink as a liquid.

The liquid ejection apparatus 1 has an outer shell 100 that forms the outer surface. The outer shell 100 has a substantially rectangular parallelepiped shape, and has an upper face (first face, first wall) 101, a lower face (second face, second wall) 102, a front face (third face, third wall) 103, a rear face (fourth face, fourth wall) 104, a right side face (fifth face, fifth wall) 105, and a left side face (sixth face, sixth wall) 106. The upper face 101 is opposed to the lower face 102 in the Z axis direction. The front face 103 is opposed to the rear face 104 in the X axis direction. The right side face 105 is opposed to the left side face 106 in the Y axis direction. The front face 103, the rear face 104, the right side face 105, and the left side face 106 are faces substantially vertical to an installation face of the liquid ejection apparatus 1. The upper face 101 and the lower face 102 are faces substantially horizontal to the installation face of the liquid ejection apparatus 1. Note that, in this embodiment, "substantially vertical" and "substantially horizontal" include "generally vertical" and "generally horizontal" as well as "perfectly vertical" and "perfectly horizontal". Accordingly, those faces 101 to 106 are not perfect flat faces, and allow for irregularities and the like, and it suffices for the faces 101 to 106 to appear "generally vertical" or "generally horizontal".

The liquid ejection apparatus 1 further has a front face cover 2, a discharge port 3, an operation unit 4, and an upper face cover 6. The front face cover 2 constitutes a portion of the front face 103, is axially supported at its lower end portion, and can be opened/closed by pivoting the upper end portion side. In FIG. 1, the front face cover 2 is in an open state. The discharge port 3 is exposed by opening the front face cover 2.

The discharge port 3 is a portion from which a recording medium is discharged. Note that a recording medium may be arranged in a tray provided on the rear face 104 side (not illustrated). Printing on the recording medium is executed by conveying the recording medium arranged on the tray into the outer shell 100 and ejecting liquid onto the recording medium.

The operation unit 4 consists of buttons that accept various operations from the user. For example, the various operations include an operation of starting printing of the liquid ejection apparatus 1, and an operation for executing a discharging operation for discharging fluid in a liquid tank to the outside, which will be described later.

The upper face cover 6 constitutes the upper face 101. The end portion of the upper face cover 6 on the rear face 104 side is axially supported, and the upper face cover 6 can be opened/closed by pivoting the front face 103 side. By opening the upper face cover 6, it is possible to check the internal state of the liquid ejection apparatus 1, perform a mounting/removing operation on the liquid tank, which will be described later, and inject liquid into the liquid tank.

A window portion 103*a* of the apparatus is formed in a region in the front face 103 overlapping a home position of a carriage 19 in the Y axis direction (the direction of reciprocal movement of the carriage 19 to be described later). In this embodiment, the window portion 103*a* of the apparatus is arranged at a position different from that of the front face cover 2, and is arranged on the −Y axis direction side relative to the front face cover 2. The window portion 103*a* of the apparatus is provided in order to allow the user to visually recognize, from the outside, a front face (visual recognition face) 404 of the liquid tank 30 mounted on the carriage 19 positioned at the home position. The front face 404 is a liquid visual recognition wall that makes it possible to visually recognize the liquid in a second liquid chamber 52 from the outside. In addition, signs M1 and M2 are provided in the front face 404. For example, the window portion 103*a* of the apparatus may be a through hole that penetrates the front face 103, or may be a transparent member. The signs M1 and M2 are elements for indicating references for the level of liquid contained in the liquid tank 30, and, in this embodiment, the sign M1 indicates a reference of an upper limit, and the sign M2 indicates a reference of a lower limit. The signs M1 and M2 will be described later in detail. Note that as long as the front face 404 of the liquid tank 30 at the home position can be visually recognized from the outside, the window portion 103*a* of the apparatus does not need to be provided in the front face 103. For example, the window portion 103*a* of the apparatus may be provided in the upper face 101. In this case, the user can visually recognize the front face 404 of the liquid tank 30 by visually recognizing the window portion 103*a* of the apparatus from above and front on.

Figure 2:
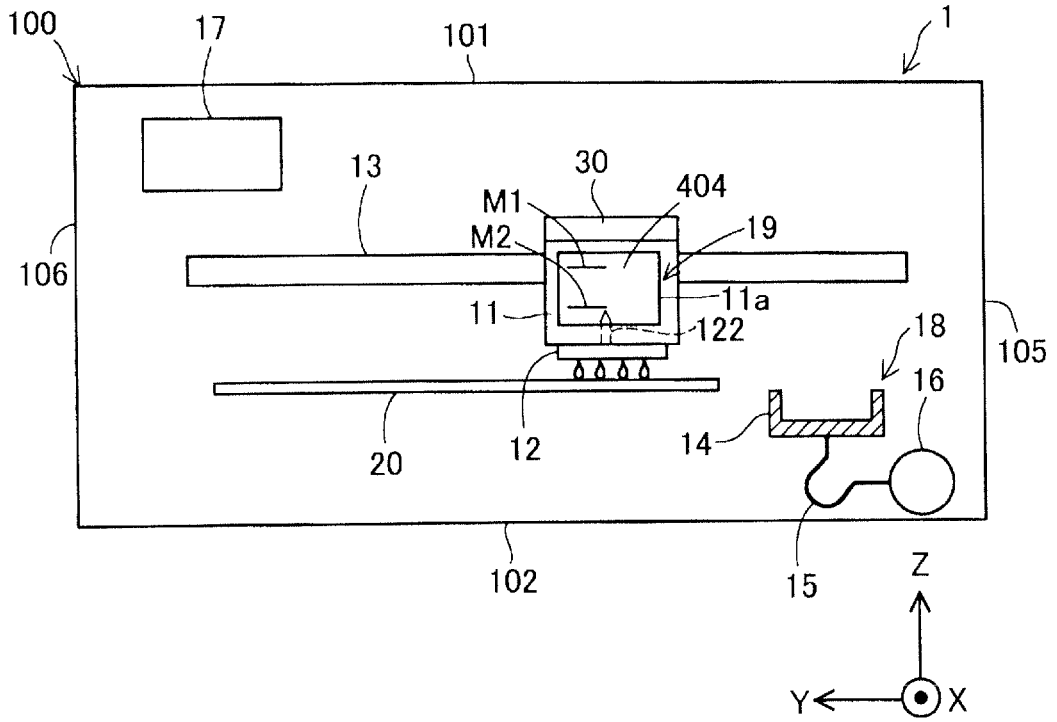
FIG. 2 is a schematic diagram showing the internal configuration of a liquid ejection apparatus.

FIG. 2 is a schematic diagram showing the internal configuration of the liquid ejection apparatus 1. The liquid ejection apparatus 1 has, inside the outer shell 100, a control unit 17, the carriage 19 provided with a liquid ejection head 12, and the liquid tank 30 that is detachably mounted on the carriage 19. The control unit 17 controls various operations of the liquid ejection apparatus 1 (e.g., a printing operation).

The carriage 19 has a mounting portion 11 arranged on the liquid ejection head 12. For example, the mounting portion 11 has a recessed shape that is open in the +Z axis direction, and forms a mounting space in which the liquid tank 30 is mounted. The mounting portion 11 has a liquid introduction needle portion 122 protruding in the +Z axis direction from a lower face that defines the mounting space. The liquid introduction needle portion 122 is connected to the liquid tank 30. The liquid introduction needle portion 122 is hollow, and a communication hole for communication with the inside of the liquid introduction needle portion 122 is formed on the tip end side thereof. Liquid that is supplied from the liquid tank 30 via the communication hole of the liquid introduction needle portion 122 flows inside the liquid introduction needle portion 122. The liquid ejection head 12 is in communication with the liquid introduction needle portion 122, and ejects liquid (in this embodiment, black ink) supplied from the liquid tank 30 toward a recording medium 20 (e.g., printing paper).

In addition, the mounting portion 11 has a window portion 11*a* of the mounting portion for the user to visually recognize the front face (visual recognition face) 404 including the signs M1 and M2. The window portion 11*a* of the mounting portion is provided at least at a position opposed to the sign M1 of the liquid tank 30. For example, the window portion 11*a* of the mounting portion may be a through hole that penetrates a wall that forms the mounting portion 11, or may be a transparent member. In the case where the carriage 19 is positioned at the home position, the user can visually recognize the front face 404 (visual recognition face) with the signs M1 and M2 via the window portion 103*a* of the apparatus (FIG. 1) and the window portion 11*a* of the mounting portion.

The carriage 19 equipped with the liquid ejection head 12 is driven by a driving mechanism (not illustrated), and repeats reciprocal movement above the recording medium 20 while being guided by a guide rail 13 extending in the Y axis direction. In addition, the liquid ejection apparatus 1 has a conveyance mechanism for conveying the recording medium 20 toward the discharge port 3 (FIG. 1). An image or the like is printed onto the recording medium 20 by ejecting liquid from the liquid ejection head 12 in accordance with the movement of the carriage 19 that reciprocally moves, and movement of conveyance of the recording medium 20.

The liquid tank 30 contains liquid to be supplied to the liquid ejection head 12. In this embodiment, the contained liquid is black ink, and is ink in which pigment particles are dissolved in a solvent. The liquid tank 30 is detachably connected to the liquid introduction needle portion 122. By connecting the liquid tank 30 to the liquid introduction needle portion 122, liquid in the liquid tank 30 can flow to the liquid introduction needle portion 122.

The liquid ejection apparatus 1 further has a discharge portion 18 that executes an operation (discharging operation) of periodically sucking out a fluid (e.g., liquid or air) from the liquid ejection head 12.

The discharge portion 18 is arranged inside the outer shell 100. The discharge portion 18 includes a cap 14, a suction tube 15, and a suction pump 16. While the liquid ejection apparatus 1 is not performing a printing operation, the carriage 19 is arranged at the home position that is out of a movement region of a printing operation.

The cap 14 is a member arranged below the home position and shaped like a bottomed box. The cap 14 can move in the Z axis direction (the up-down direction) due to an elevation mechanism (not illustrated). The cap 14 presses against the lower face of the liquid ejection head 12 by moving upward. Accordingly, the cap 14 forms a closed space such that nozzle holes formed in the lower face of the liquid ejection head 12 are covered (a closed space state). It is possible to suppress the drying of ink in the liquid ejection head 12 (nozzles) using this closed space.

The suction tube 15 allows the cap 14 (specifically, a through hole formed in the bottom face of the cap 14) and the suction pump 16 to be in communication with each other. The suction pump 16 sucks fluid (liquid or air) in the liquid ejection head 12 or the liquid tank 30 via the suction tube 15 by being driven in the closed space state. Initial filling of the liquid ejection head 12 with liquid can be performed in this manner, and deteriorated liquid (dried and thickened liquid) in the liquid ejection head 12 can be sucked out.

A-2. Overview of Liquid Tank

Figure 3:
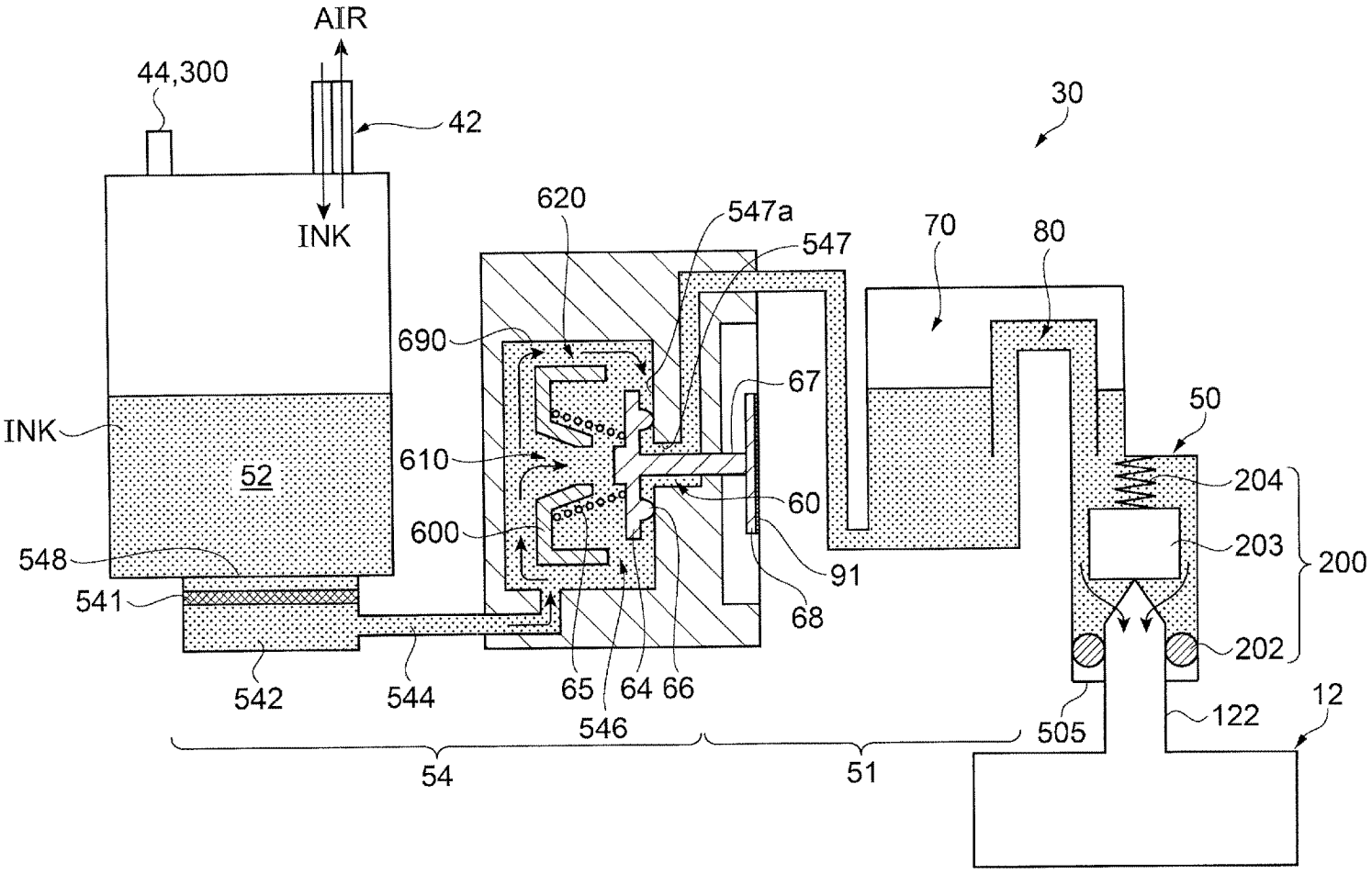
FIG. 3 is a conceptual diagram for describing mainly the channel configuration of a liquid tank.

FIG. 3 is a conceptual diagram for describing mainly the channel configuration of the liquid tank 30. Before describing a detailed configuration of the liquid tank 30, the liquid tank 30 is schematically described below with reference to FIG. 3. In addition, the "upstream side" and the "downstream side" that are used in the following description are based on the direction in which liquid flows from the liquid tank 30 toward the liquid ejection head 12. Note that, in FIG. 3, regions in which liquid exists are indicated by dots.

The liquid tank 30 includes, as a channel through which liquid flows, the second liquid chamber 52, a connection channel 54, a first liquid chamber 51, a liquid communication channel 80, and a liquid supply portion 50 from the upstream side in the stated order. The liquid tank 30 also includes an air communication channel 70 as a channel through which air flows.

Liquid can be injected into the second liquid chamber 52 from the outside through a liquid injection portion 42. In addition, the second liquid chamber 52 is in communication with atmospheric air due to an atmospheric air communication portion 300 that includes an atmospheric air release portion 44 as one end. The second liquid chamber 52 can be in communication with a first liquid chamber 51, and contain liquid to be supplied to the first liquid chamber 51, in other words, liquid that is yet to be contained in the first liquid chamber 51.

The connection channel 54 can connect the first liquid chamber 51 and the second liquid chamber 52 so as to supply liquid in the second liquid chamber 52 to the first liquid chamber 51. The connection channel 54 has a filter chamber 542, an intermediate channel 544, and a valve-arranged chamber 546 from the upstream side in the stated order. The filter chamber 542 is formed to be positioned below the second liquid chamber 52, in the mounted state of the liquid tank 30. The filter chamber 542 is connected to the second liquid chamber 52. Specifically, the filter chamber 542 has a flow-in opening 548 that is an opening formed in a bottom face of the second liquid chamber 52. Accordingly, the flow-in opening 548 is connected to the second liquid chamber 52. A filter member 541 that demarcates the filter chamber 542 on the upstream side and the filter chamber 542 on the downstream side is arranged in the filter chamber 542, and the filter chamber 542 is connected to the second liquid chamber 52 via the filter member 541. The filter member 541 catches extraneous materials in a liquid that flows from the upstream side to the downstream side, and keeps the extraneous materials from flowing downstream. Accordingly, it is possible to reduce the likelihood of extraneous material flowing into the liquid ejection head 12, and thus it is possible to reduce clogging in the liquid ejection head 12 and the occurrence of a liquid ejection error. In addition, due to the filter chamber 542 being arranged on the upstream side relative to the valve-arranged chamber 546, the likelihood of extraneous material flowing into the valve-arranged chamber 546 is reduced. Accordingly, it is possible to reduce the likelihood of a malfunction occurring in an opening/closing operation of a valve mechanism to be described later caused by extraneous material. The filter member 541 is a filter that is formed as a plate-like piece of stainless steel, and has a plurality of pores that allow liquid to pass through and can suppress extraneous materials from passing through. Note that the filter member 541 may be formed by another member, as long as liquid is allowed to pass through and the passing of extraneous materials can be suppressed.

The intermediate channel 544 is a channel that connects the filter chamber 542 and the first liquid chamber 51, and is a channel that allows the filter chamber 542 and the valve-arranged chamber 546 to be in communication with each other. The valve-arranged chamber 546 has an inlet opening portion 547 connected to the first liquid chamber 51. Accordingly, the inlet opening portion 547 forms one end of the connection channel 54 (downstream end). The inlet opening portion 547 forms a through hole whose channel cross-section is circular. A portion of a valve mechanism 60 for controlling the flow of liquid from the second liquid chamber 52 into the first liquid chamber 51 by opening/closing the inlet opening portion 547 is arranged in the valve-arranged chamber 546. Due to the valve mechanism 60 entering an open state, the second liquid chamber 52 and the first liquid chamber 51 come into communication with each other, and the liquid in the second liquid chamber 52 flows into the first liquid chamber 51. In addition, due to the valve mechanism 60 entering a closed state, the second liquid chamber 52 and the first liquid chamber 51 are brought into a non-communication state.

Inside an exterior wall 690 that constitutes the valve mechanism 60, the valve mechanism 60 includes a channel member 600, a biasing member 65, a valve body 64, and a rod 67 from the upstream side of flow of liquid in the stated order. The channel member 600 is provided inside the biasing member 65, and includes a first channel 610 through which liquid can pass. In addition, the exterior wall 690 and the biasing member 65 form a second channel 620 through which liquid can pass therebetween. The valve body 64 is a disk-shaped member, and is arranged in the valve-arranged chamber 546. The valve body 64 is opposed to the inlet opening portion 547 so as to sandwich a sealing member 66 having an annular projection. The sealing member 66 is arranged in a peripheral edge portion of the inlet opening portion 547 so as to surround the inlet opening portion 547. Due to the sealing member 66 of the valve body 64 abutting against an opening peripheral face 547*a* of the inlet opening portion 547, the valve-arranged chamber 546 and the first liquid chamber 51 are brought into a non-communication state. Due to the sealing member 66 of the valve body 64 moving away from the opening peripheral face 547*a* of the inlet opening portion 547, the valve-arranged chamber 546 and the first liquid chamber 51 are brought into a communication state. The rod 67 is a bar member with one end connected to the valve body 64, and the other end able to abut against the pressure receiving plate 68. The rod 67 is inserted into the inlet opening portion 547. The pressure receiving plate 68 is a disk-shaped member. A first film 91 is arranged so as to cover the pressure receiving plate 68 and be able to abut against the pressure receiving plate 68.

The biasing member 65 is a compression coil spring arranged in the valve-arranged chamber 546. The biasing member 65 biases the pressure receiving plate 68 toward the first film 91. When the pressure in the first liquid chamber 51 reaches a predetermined negative pressure due to liquid in the first liquid chamber 51 being supplied by the liquid ejection head 12 and consumed, the pressure receiving plate 68, the rod 67, and the valve body 64 are biased against the biasing force of the biasing member 65 by the first film 91 in a direction away from the inlet opening portion 547. Accordingly, due to the sealing member 66 of the valve body 64 moving away from the opening peripheral face 547*a* of the inlet opening portion 547, the valve mechanism 60 enters an open state, and the valve-arranged chamber 546 and the first liquid chamber 51 are brought into a communication state. In the communication state, when liquid is supplied from the second liquid chamber 52 to the first liquid chamber 51, and the pressure in the first liquid chamber 51 rises to a certain degree (e.g. when the predetermined negative pressure is exceeded), the sealing member 66 of the valve body 64 moves toward the opening peripheral face 547*a* side of the inlet opening portion 547 due to the biasing force of the biasing member 65, and abuts against the opening peripheral face 547*a*. Accordingly, the valve mechanism 60 enters a closed state, and the valve-arranged chamber 546 and the first liquid chamber 51 are brought into a non-communication state. As described above, the valve mechanism 60 enters an open state at least when the pressure in the first liquid chamber 51 reaches the predetermined negative pressure, and thus the pressure in the first liquid chamber 51 can be stabilized.

The first liquid chamber 51 can contain liquid to be supplied to the liquid supply portion 50. The liquid communication channel 80 can connect the first liquid chamber 51 and the liquid supply portion 50 so as to supply liquid in the first liquid chamber 51 to the liquid supply portion 50. The air communication channel 70 can connect the first liquid chamber 51 and the liquid supply portion 50, and can allow air to flow between the first liquid chamber 51 and the liquid supply portion 50.

The liquid supply portion 50 has a liquid supply port 505 at its downstream end. The liquid supply port 505 accommodates the liquid introduction needle portion 122. The liquid supply portion 50 is detachably connected to the liquid introduction needle portion 122 of the liquid ejection head 12. Specifically, by inserting the liquid introduction needle portion 122 into the liquid supply portion 50 via the liquid supply port 505 of the liquid supply portion 50, the liquid supply portion 50 is connected to the liquid introduction needle portion 122. Accordingly, liquid can be supplied from the liquid supply portion 50 to the liquid introduction needle portion 122.

A supply portion valve mechanism 200 for opening/closing the channel of the liquid supply portion 50 is arranged in the liquid supply portion 50. The supply portion valve mechanism 200 has a valve seat 202, a valve body 203, and a spring 204 from the downstream side in the stated order.

The valve seat 202 is an approximately annular member. The valve seat 202 is formed of an elastic body made of rubber, elastomer, and the like. The valve seat 202 is press-fitted in the liquid supply portion 50. The valve body 203 is a substantially columnar member. In a state before the liquid tank 30 is mounted on the carriage 19 (a pre-mounted state), the valve body 203 blocks a hole (a valve hole) formed in the valve seat 202. The spring 204 is a compression coil spring. The spring 204 biases the valve body 203 toward the valve seat 202. In the mounted state of the liquid tank 30 in which the liquid tank 30 is mounted on the carriage 19, and the liquid supply portion 50 is connected to the liquid introduction needle portion 122, the valve body 203 moves in a direction away from the valve seat 202 due to the liquid introduction needle portion 122 pressing the valve body 203 to the upstream side. Accordingly, the supply portion valve mechanism 200 enters an open state, and liquid can be supplied from the liquid supply portion 50 to the liquid introduction needle portion 122.

A-3. Detailed Configuration of Liquid Tank 30

Figure 4:
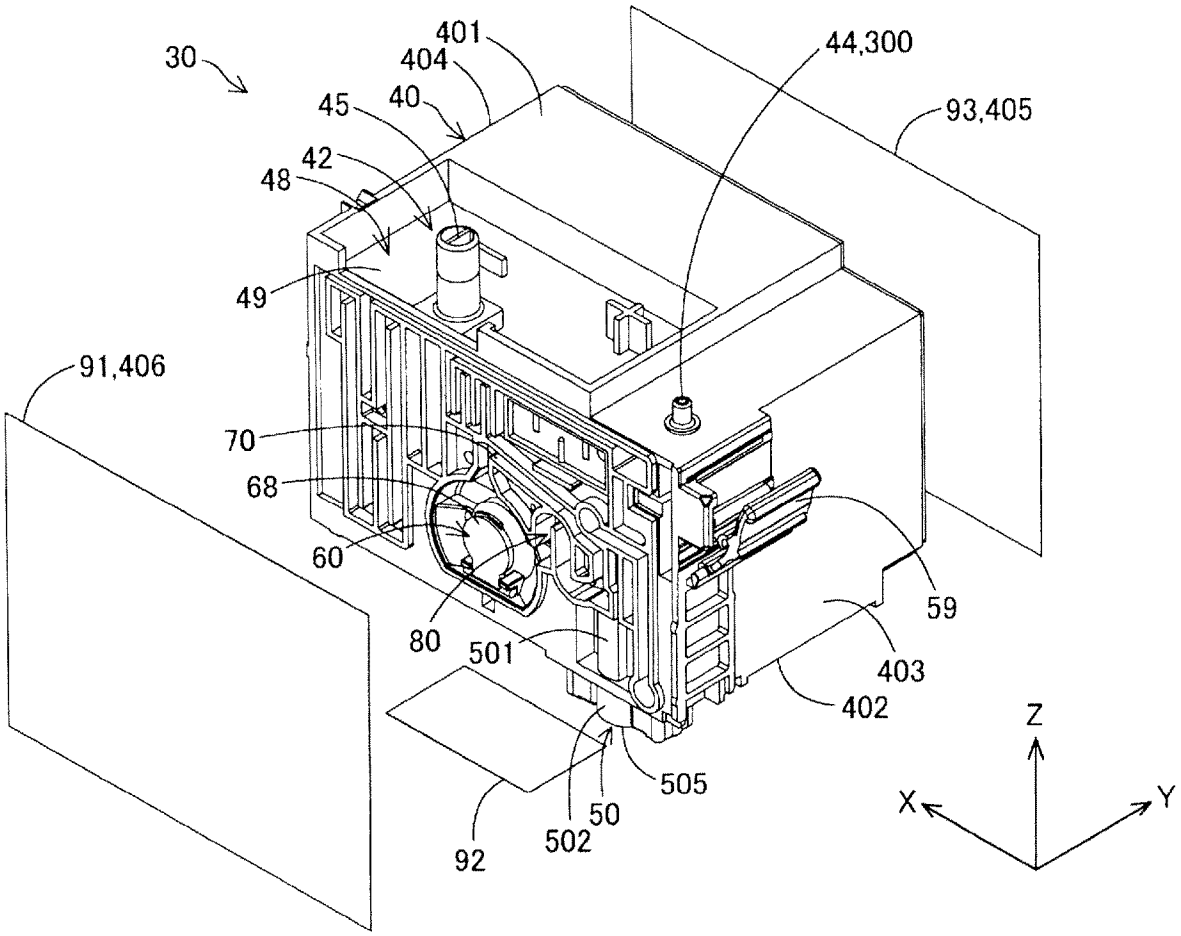
FIG. 4 is a partial exploded perspective view of the liquid tank.
Figure 5:
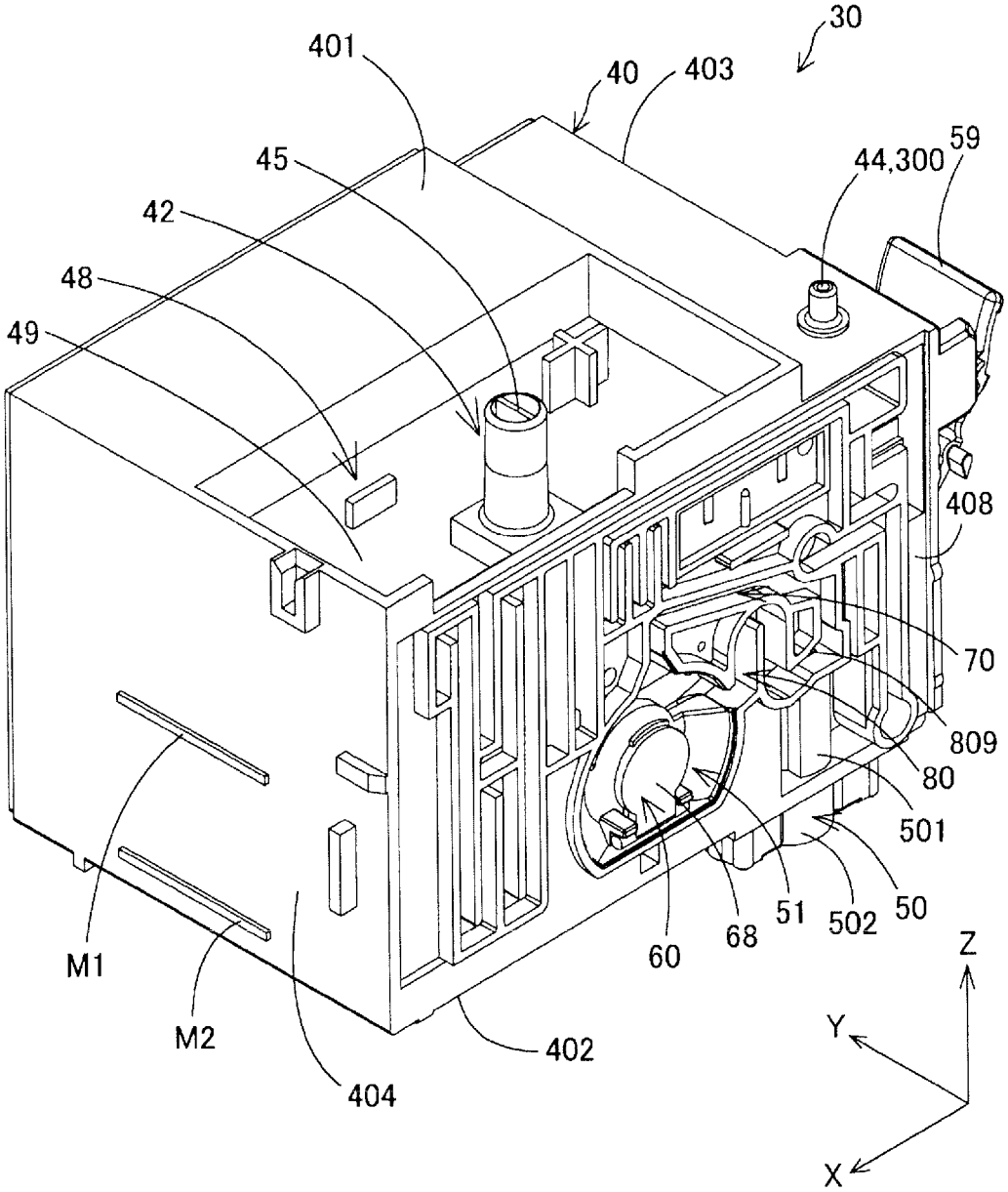
FIG. 5 is a first perspective view of a tank body.
Figure 6:
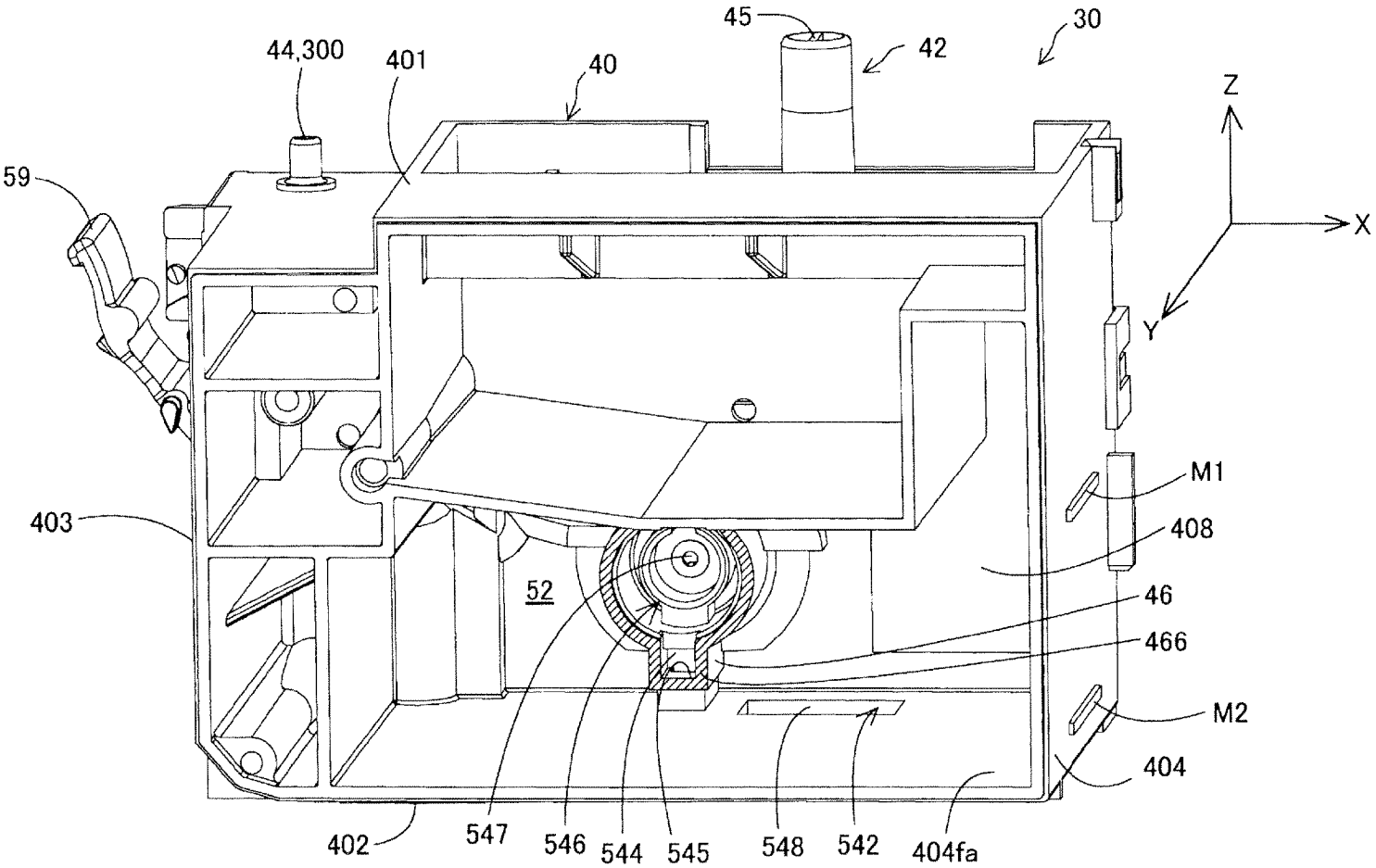
FIG. 6 is a second perspective view of the tank body.
Figure 7:
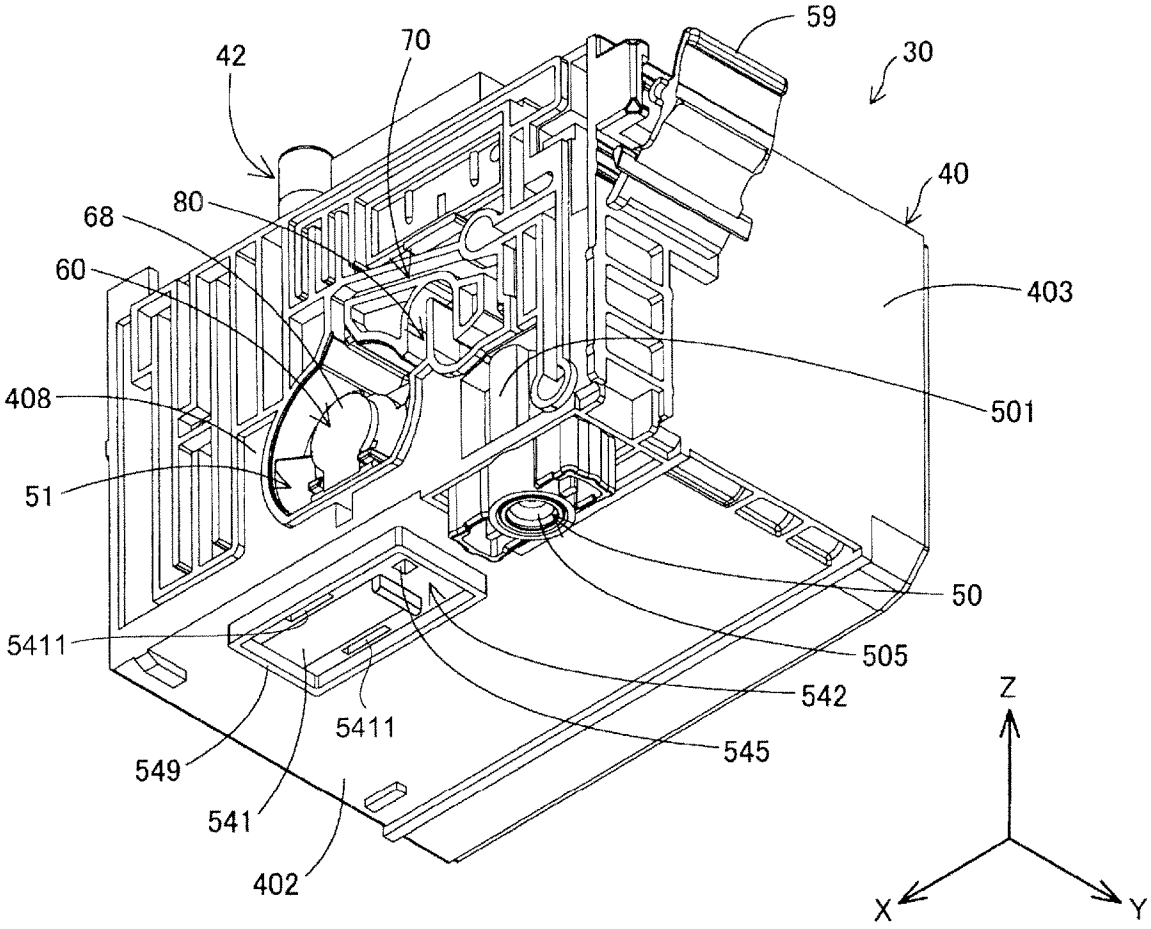
FIG. 7 is a third perspective view of the tank body.
Figure 8:
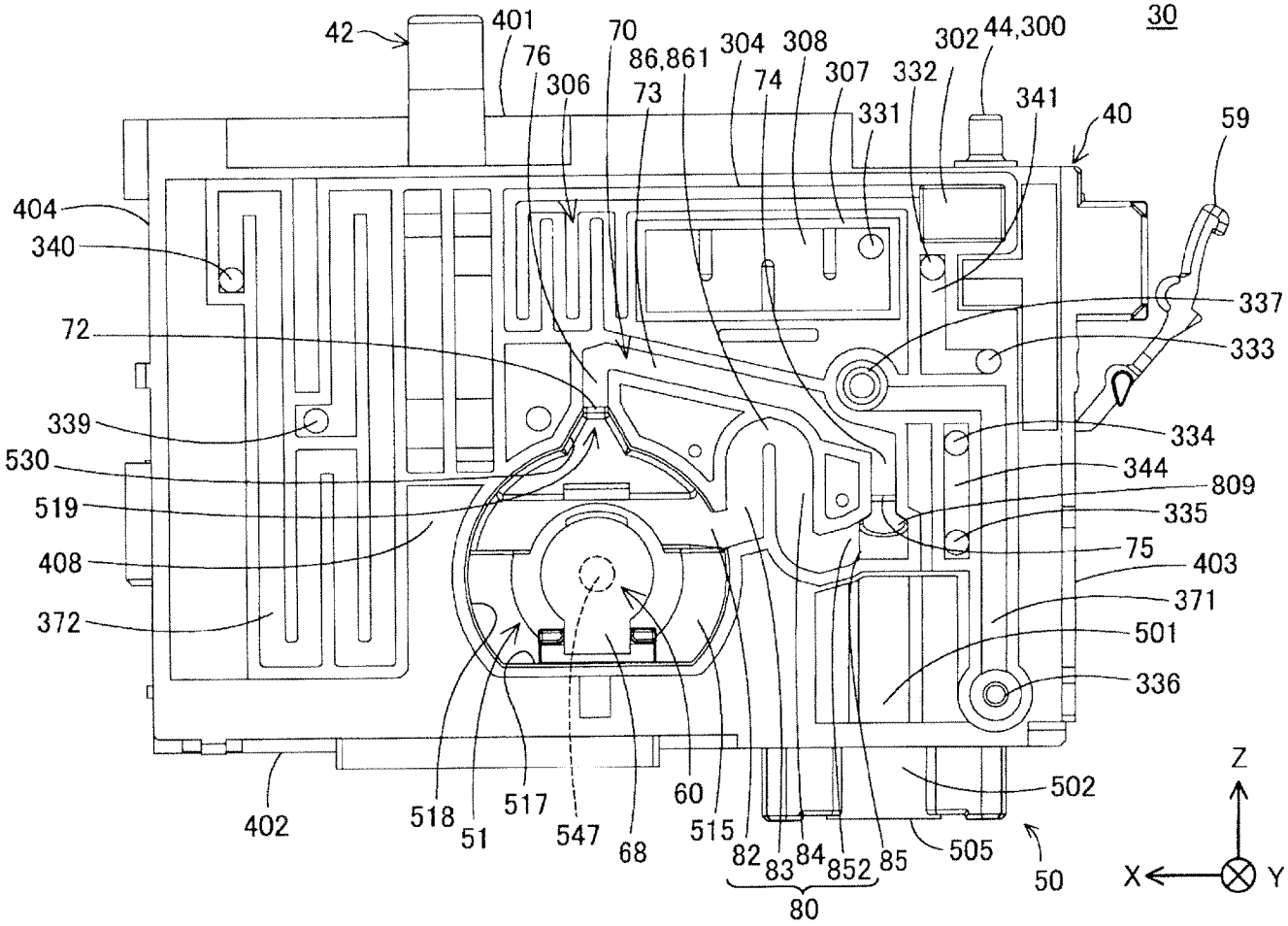
FIG. 8 is a first diagram of the tank body viewed from a −Y axis direction side.
Figure 9:
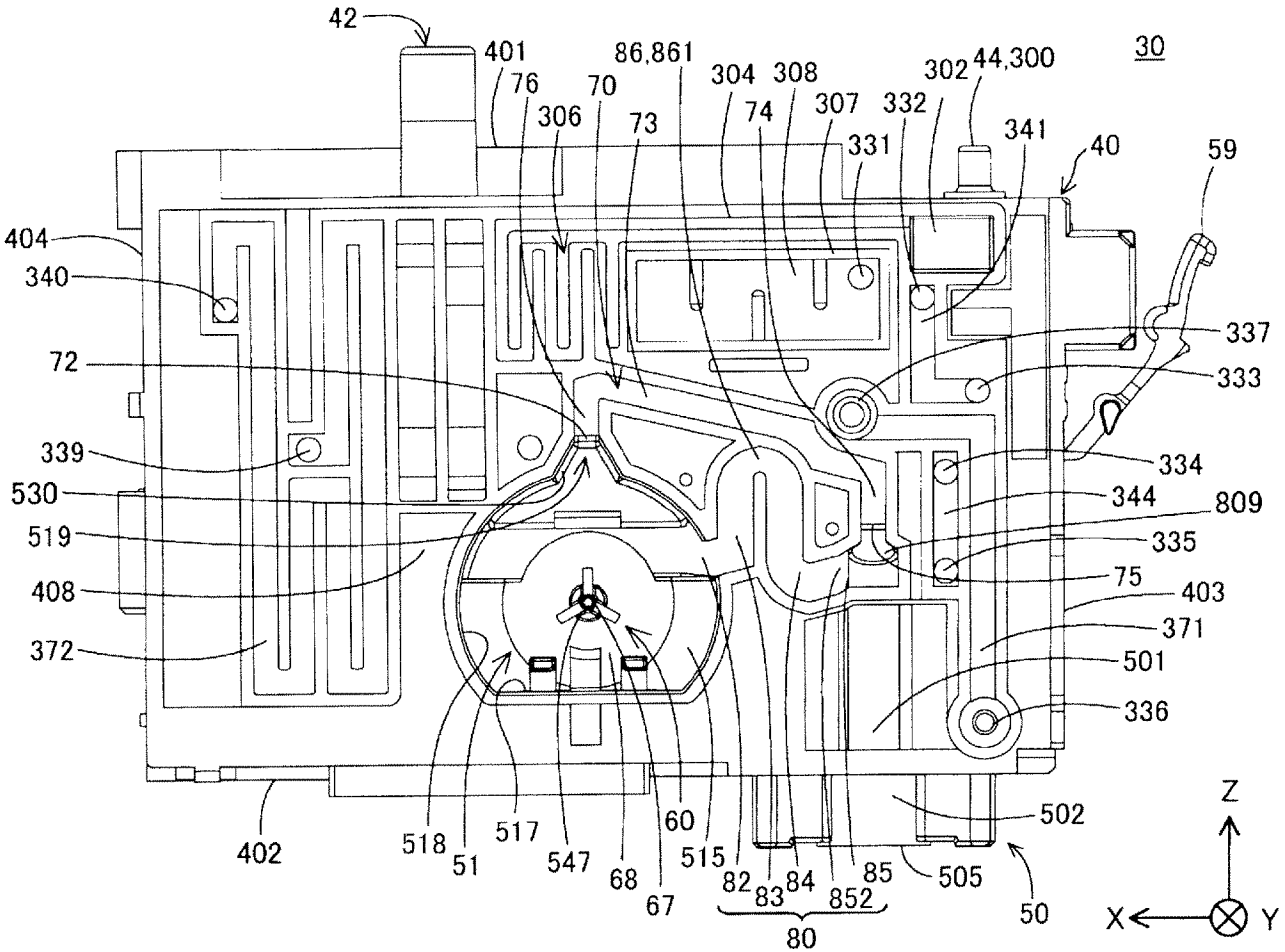
FIG. 9 is a second diagram of the tank body viewed from the −Y axis direction side.
Figure 10A:
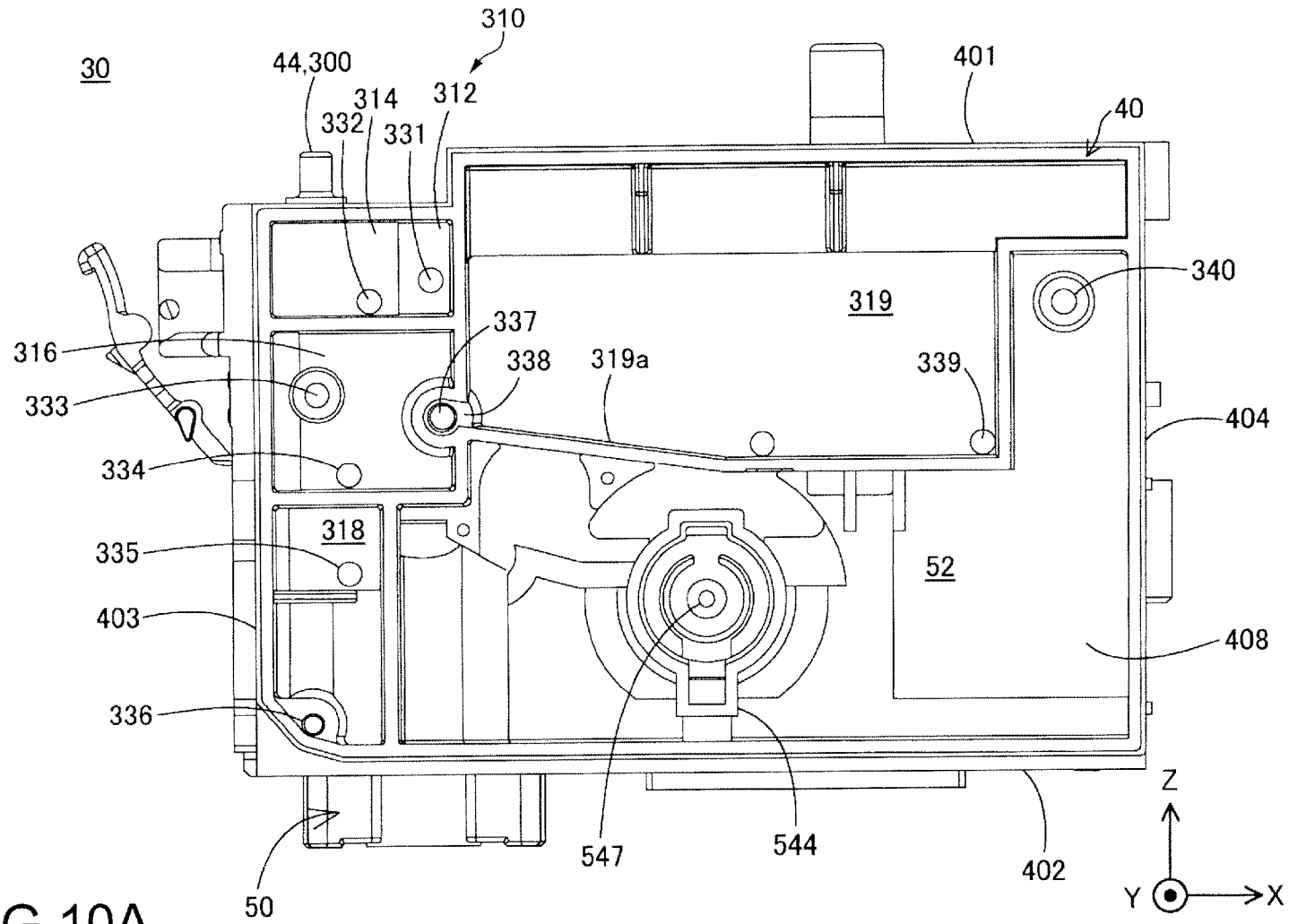
FIG. 10A is a diagram of the tank body viewed from a +Y axis direction side.
Figure 10B:
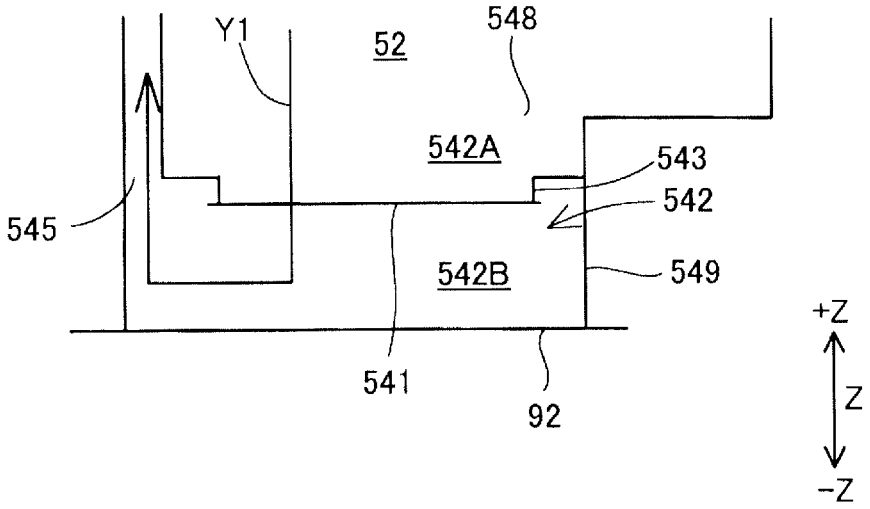
FIG. 10B is a schematic diagram of a filter chamber.

FIG. 4 is a partial exploded perspective view of the liquid tank 30. FIG. 5 is a first perspective view of a tank body 40. FIG. 6 is a second perspective view of the tank body 40. FIG. 7 is a third perspective view of the tank body 40. FIG. 8 is a first diagram of the tank body 40 viewed from the −Y axis direction side. FIG. 9 is a second diagram of the tank body 40 viewed from the −Y axis direction side. FIG. 10A is a diagram of the tank body 40 viewed from the +Y axis direction side. FIG. 10B is a schematic diagram of the filter chamber 542. FIGS. 5, 6, 7, and 8 also illustrate the valve mechanism 60 arranged in the tank body 40. FIG. 9 illustrates not only the valve mechanism 60 but also the rod 67 in the valve mechanism 60.

As shown in FIG. 4, the liquid tank 30 includes the tank body 40, the first film 91, a second film 92, and a third film 93. The liquid tank 30 has a substantially rectangular parallelepiped shape. In the liquid tank 30, the X axis direction is a length direction, the Y axis direction is a width direction, and the Z axis direction is a height direction.

The liquid tank 30 has an upper face (first face, first wall) 401, a lower face (second face, second wall) 402, a rear face (third face, third wall) 403, a front face (fourth face, fourth wall) 404, a left side face (fifth face, fifth wall) 405, and a right side face (sixth face, fifth wall) 406. In the mounted state in which the liquid tank 30 is mounted on the carriage 19, the upper face 401 is opposed to the lower face 402 in the Z axis direction. In the mounted state, the rear face 403 is opposed to the front face 404 in the X axis direction. In the mounted state, the left side face 405 is opposed to the right side face 406 in the Y axis direction. The left side face 405 is formed by the third film 93. The right side face 406 is formed by the first film 91. The tank body 40 is formed by the upper face 401, the lower face 402, the rear face 403, and the front face 404. The rear face 403, the front face 404, the left side face 405, and the right side face 406 are faces substantially vertical to the installation face of the liquid ejection apparatus 1. The upper face 401 and the lower face 402 are faces substantially horizontal to the installation face of the liquid ejection apparatus 1. The faces 401 to 406 are not perfect flat faces, and may include irregularities and the like, and it suffices for those faces 401 to 406 to appear generally "vertical" or generally "horizontal".

In addition, the front face 404 constitutes a visual recognition face that enables visual recognition of the level of liquid in the liquid tank 30 (specifically, the second liquid chamber 52) from the outside. For example, the front face 404 (visual recognition face) is formed by a transparent or semi-transparent member. Signs (e.g., a scale and mark) corresponding to references (e.g., an upper limit and lower limit) of the level of liquid (liquid surface) may be provided in the front face 404. In this embodiment, as shown in FIG. 5, the upper limit sign M1 that is a sign corresponding to the upper limit and the lower limit sign M2 that is a sign corresponding to the lower limit are provided in the front face 404. For example, in the case where the liquid surface reaches the upper limit sign M1 corresponding to the upper limit when injecting liquid from the liquid injection portion 42, the user stops injecting the liquid. In addition, for example, in the case where the liquid surface in the liquid tank 30 (specifically, the second liquid chamber 52) reaches the lower limit sign M2, the user injects liquid from the liquid injection portion 42 into the second liquid chamber 52.

A lever 59 for mounting/removing the liquid tank 30 to/from the mounting portion 11 of the carriage 19 (FIG. 2) is provided on the rear face 403. The lever 59 suppresses removal of the liquid tank 30 from the mounting portion 11 by engaging with the mounting portion 11, in the mounted state. The mounting portion 11 elastically deforms. The user releases engagement with the mounting portion 11 by pressing the lever 59 toward the rear face 403 such that the lever 59 elastically deforms toward the rear face 403. The liquid tank 30 can be removed from the mounting portion 11 by releasing this engagement.

The tank body 40 has a substantially rectangular parallelepiped shape, and is made of a synthetic resin such as polypropylene or polystyrene. The first film 91, the second film 92, and the third film 93 are each attached to different portions of the tank body 40 in an airtight manner, and thereby demarcate and form, with the tank body 40, channels and the like in the liquid tank 30 through which liquid and air flow.

The tank body 40 (FIG. 6) has a recessed shape open on the +Y axis direction side. The tank body 40 has one side wall 408 that forms a bottom portion of the tank body 40 having a recessed shape. The one side wall 408 is a wall that demarcates the first liquid chamber 51 and the second liquid chamber 52.

The one side wall 408 is substantially parallel to the X axis direction and the Z axis direction. As shown in FIG. 5, the first liquid chamber 51, the liquid communication channel 80, and the air communication channel 70 are formed on one side (the −Y axis direction side) of the one side wall 408. In addition, as shown in FIG. 6, the second liquid chamber 52 is formed on the other side (the +Y axis direction side) that is on the opposite side to the one side of the one side wall 408. Accordingly, the first liquid chamber 51, the liquid communication channel 80, the air communication channel 70, and the second liquid chamber 52 can be arranged by efficiently using the space of the liquid tank 30, and thus an increase in the size of the liquid tank 30 can be suppressed.

As shown in FIGS. 4 and 8, groove portions that demarcate and form the air communication channel 70 and the liquid communication channel 80, and recessed portions that form the first liquid chamber 51 are formed in the one side wall 408. By attaching the first film 91 to the end face on the −Y axis direction side of the one side wall 408 in an airtight manner, the first liquid chamber 51, the air communication channel 70, and the liquid communication channel 80 are demarcated and formed. In addition, as shown in FIGS. 4 and 6, the second liquid chamber 52 is formed by the third film 93 being attached to the end face on the +Y axis direction side of the tank body 40 opposing the one side wall 408 in an airtight manner.

The tank body 40 (FIG. 4) further has the liquid injection portion 42. The liquid injection portion 42 extends in the +Z axis direction from a bottom face 49 of a corner portion 48 at which the upper face 401, the front face 404, and the right side face 406 intersect each other. The liquid injection portion 42 is a cylindrical member, and forms a first channel and a second channel. A partition wall 45 is arranged in the liquid injection portion 42. This partition wall 45 partitions the liquid injection portion 42 into the first channel and the second channel. When injecting liquid, the first channel functions as a liquid injection path for allowing liquid to flow into the second liquid chamber 52, and the second channel functions as an air discharge path for discharging air from the second liquid chamber 52. A cap (not illustrated) is mounted on the liquid injection portion 42 during use of the liquid in the liquid tank 30. In addition, the atmospheric air release portion 44 that is one end of the atmospheric air communication portion 300 is formed in an upper portion of the tank body 40. The atmospheric air communication portion 300 has a thin groove-like channel and a buffer chamber that can contain ink flowing backward. The other end portion of the atmospheric air communication portion 300 is connected to the second liquid chamber 52. Accordingly, when the liquid tank 30 is used, the second liquid chamber 52 is in communication with atmospheric air. The atmospheric air communication portion 300 will be described later in detail.

As shown in FIG. 6, the second liquid chamber 52 has the second liquid chamber bottom face 404*fa* that forms the bottom face in the mounted state. The second liquid chamber bottom face 404*fa* is the internal surface of the lower face 402. The flow-in opening 548 penetrating the second liquid chamber bottom face 404*fa* in the vertically downward direction (the −Z axis direction) is formed in the second liquid chamber bottom face 404*fa*. The flow-in opening 548 is the upstream end of the filter chamber 542 formed in the lower face 402.

The filter chamber 542 (FIG. 7) is demarcated and formed by a frame-like member 549 protruding from the lower face 402 and the second film 92 (FIG. 4) attached to the lower end face of the frame-like member 549 in an airtight manner. The filter chamber 542 is positioned below the second liquid chamber 52 (the −Z axis direction) in the mounted state. The filter member 541 is arranged inside the frame-like member 549. In this embodiment, for example, the filter member 541 is arranged in a frame-like arrangement portion 543 (FIG. 10B) formed inside the frame-like member 549. The filter member 541 is shaped like a plate, and is orthogonal to the vertically downward direction (the −Z axis direction) in the mounted state. In addition, a communication opening 545 that is in communication with the intermediate channel 544 is formed in a peripheral edge portion of the filter member 541 (FIGS. 7 and 10B). Liquid in the second liquid chamber 52 passes through the flow-in opening 548 and the filter member 541 by flowing along the −Z axis direction as indicated by an arrow Y1, and the liquid that has passed through the filter member 541 passes through the communication opening 545 by flowing along the +Z axis direction. The liquid that has passed through the communication opening 545 flows into the intermediate channel 544. As described above, in the mounted state, the filter member 541 (FIG. 10B) demarcates, from the filter chamber 542, an upper first portion 542A that includes the flow-in opening 548 and a second portion 542B positioned below the first portion 542A. In addition, the filter member 541 is positioned below the flow-in opening 548 in the mounted state. Accordingly, even in the case where air bubbles adhere to the filter member 541, it is possible to guide the adhering air bubbles to the second liquid chamber 52 via the flow-in opening 548, and thus it is possible to reduce the likelihood of air bubbles flowing out to the first liquid chamber 51 and the liquid supply portion 50.

Furthermore, in the filter chamber 542, communication holes 5411 that are in communication with the second liquid chamber 52 are provided at the two ends of the filter member 541 in the Y axis direction. Accordingly, these communication holes 5411 are arranged along the moving direction of the carriage 19.

Here, when the carriage 19 is reciprocally moved in the Y axis direction in the state where the liquid tank 30 is mounted in the carriage 19 (usage state), air bubbles are likely to attach to the filter member 541 due to vibration of the carriage 19. However, according to this embodiment, air bubbles attached to the filter member 541 move in the Y axis direction due to reciprocal movement of the carriage 19 in the Y axis direction. The air bubbles can then be guided to the second liquid chamber 52 via one of the communication holes 5411 provided at the two ends of the filter member 541 in the Y axis direction. Therefore, it is possible to reduce the likelihood of air bubbles flowing out to the first liquid chamber 51 side.

The intermediate channel 544 and the valve-arranged chamber 546 (FIG. 6) are formed inside the second liquid chamber 52. The intermediate channel 544 and the valve-arranged chamber 546 are demarcated and formed by the one side wall 408, a channel wall 46 that rises from the one side wall 408 toward the opening side of the tank body 40 with a recessed shape (the +Y axis direction side), and a film (not illustrated) attached to an end face 466 on the +Y axis direction side of the channel wall 46 in an airtight manner. The end face 466 to which the film is attached is indicated by single hatching.

The intermediate channel 544 (FIG. 6) is a channel extending in a direction along the gravity direction in the mounted state. The direction along the gravity direction is a direction that is generally perpendicular to the horizontal direction, and forms an angle of 80° or more and 100° or smaller with the horizontal direction. In the mounted state, due to the intermediate channel 544 extending in a direction along the gravity direction, the channel length of the intermediate channel 544 can be set to be short compared with a case of extending in a direction intersecting the gravity direction. Here, in the case where liquid in the liquid tank 30 has been consumed, and the liquid has been consumed to the extent where the liquid surface falls to the position of the filter member 541, air bubbles flow in to the channel on the downstream side relative to the filter member 541. Thus, in the case where the liquid surface has fallen to the position of the filter member 541, the supply of liquid from the liquid tank 30 to the liquid ejection head 12 is stopped. In this embodiment, by setting the channel length of the intermediate channel 544 that connects the first liquid chamber 51 and the filter chamber 542 to be short, it is possible to reduce the amount of liquid that could not be used and remaining in the intermediate channel 544. Note that, in another embodiment, the intermediate channel 544 may be formed so as to extend in a direction including horizontal direction components and vertically upward components.

The valve-arranged chamber 546 has an approximately circular shape when the tank body 40 is viewed from the +Y axis direction side. The inlet opening portion 547 is formed in the valve-arranged chamber 546. Specifically, the inlet opening portion 547 is a through hole that penetrates the one side wall 408.

The first liquid chamber 51 (FIG. 8) is formed in the one side wall 408, and is formed by a recessed portion that is open on the horizontal direction (in this embodiment, the −Y axis direction) side and the first film 91 (FIG. 4) attached in an airtight manner to the end face of the recessed portion on the −Y axis direction side. The size of the first liquid chamber 51 in the Y axis direction is larger than that of the air communication channel 70. In other words, the first liquid chamber 51 is deeper than the air communication channel 70. The volume of the first liquid chamber 51 (maximum volume) is smaller than that of the second liquid chamber 52 (maximum volume). The first liquid chamber 51 has a side wall 515 that is opposed to the first film 91, a bottom wall 517 positioned on the vertically downward direction side in the mounted state, an arcuate peripheral wall 518 extending from the bottom wall 517 in the vertically upward direction in the mounted state, and an uppermost portion 519. The inlet opening portion 547 is formed in the side wall 515. The peripheral wall 518 has a portion opposed to the bottom wall 517. The uppermost portion 519 is a portion protruding upward from the top of the peripheral wall 518, and, in the mounted state, is arranged at the highest position in the first liquid chamber 51.

The uppermost portion 519 is a space that has a certain volume. In addition, the uppermost portion 519 is preferably provided with a tapered portion 530 whose channel cross-section area decreases upward, in other words, on the side of a connection portion 72 for air to which the air communication channel 70 is connected. In this embodiment, the uppermost portion 519 has the tapered portion 530. In the case where the uppermost portion 519 has the tapered portion 530, the volume of the uppermost portion 519 can be set to be large while suppressing an increase in the size of the first liquid chamber 51 compared with the case where the tapered portion 530 is not provided. Accordingly, it is possible to increase the amount of air that can be contained in the uppermost portion 519 (air storage volume). In addition, the volume of the uppermost portion 519 can be set to be large, and thus it is possible to suppress the flow of liquid and air bubbles from the first liquid chamber 51 to the air communication channel 70 due to a change in the environment (e.g., the temperature and air pressure) in which the liquid tank 30 is used.

The liquid communication channel 80 (FIG. 8) forms a projection-shaped channel at its upper position, in the mounted state. In this embodiment, the liquid communication channel 80 forms an inverted U-shaped channel in the mounted state. The liquid communication channel 80 has an upstream end 82, an ascending channel 83, a liquid intermediate channel 86, a descending channel 84, and a downstream end portion 852 that includes a downstream end 85 in a direction in which liquid flows, from the upstream side in the stated order. It is preferred that the channel cross-section area of the liquid communication channel 80 is larger than the channel cross-section area of the air communication channel 70. The channel cross-section area is a channel area when the channel is cut on a plane perpendicular to a direction in which fluid that flows in the channel flows. In the case where the channel cross-section area of the liquid communication channel 80 is larger than the channel cross-section area of the air communication channel 70, liquid in the first liquid chamber 51 is likely to flow to the liquid communication channel 80, compared with the case where the channel cross-section area of the liquid communication channel 80 is smaller than or equal to the channel cross-section area of the air communication channel 70. In this embodiment, the channel cross-section area of the thinnest portion of the liquid communication channel 80 is larger than the channel cross-section area of the largest portion of the air communication channel 70. Therefore, the liquid tank 30 can suppress the liquid contained in the first liquid chamber 51 from flowing into the air communication channel 70.

The upstream end 82 is an opening formed in the peripheral wall 518 of the first liquid chamber 51, and is connected to the first liquid chamber 51. The ascending channel 83 is positioned on the downstream side relative to the upstream end 82, and extends upward in the flow direction in the mounted state. In this embodiment, the ascending channel 83 extends from the upstream end 82 in the vertically upward direction. Note that, in another embodiment, the ascending channel 83 may obliquely extend as long as upward components are included. Here, in the mounted state, the inlet opening portion 547 is arranged at a position lower than the upstream end 82. In other words, the inlet opening portion 547 is arranged at a position closer to the bottom wall 517 than the upstream end 82 is.

Here, liquid contains pigment particles, and thus there are cases where, if the liquid comes into contact with air, and is exposed to a change in pressure due to the valve mechanism 60 being opened/closed, the pigment particles aggregate to become an extraneous material. As described above, in the mounted state, the inlet opening portion 547 is arranged at a position lower than the upstream end 82, and thus it is possible to suppress the liquid level from falling below the inlet opening portion 547. Thus, it is possible to suppress the existence of air in the periphery of the inlet opening portion 547, and thus it is possible to reduce the likelihood of extraneous material being generated in the periphery of the inlet opening portion 547. Accordingly, it is possible to reduce the likelihood of extraneous material flowing into the liquid ejection head 12.

The liquid intermediate channel 86 connects the ascending channel 83 and the descending channel 84. The liquid intermediate channel 86 has an uppermost portion 861 for liquid that is at the highest position in the liquid communication channel 80, in the mounted state. Accordingly, the liquid communication channel 80 is a portion positioned higher than the upstream end 82 and the downstream end 85 that form the two ends of the liquid communication channel 80, in the mounted state. The liquid intermediate channel 86 is a channel for changing the flow of liquid from upward to downward, and is a channel bent by 180 degrees. In addition, the liquid intermediate channel 86 is, in the mounted state, arranged at a position lower than the highest portion of the air communication channel 70 (the upstream end of an air second channel 73), which will be described later.

The descending channel 84 is positioned on the downstream side relative to the ascending channel 83 and the liquid intermediate channel 86 in the flow direction, and extends downward in the mounted state. In this embodiment, the descending channel 84 extends from the liquid intermediate channel 86 in the vertically downward direction. Note that, in another embodiment, the descending channel 84 may obliquely extend as long as downward components are included.

In the flow direction, the downstream end portion 852 is positioned on the downstream side relative to the descending channel 84, and is connected to the liquid supply portion 50. The downstream end portion 852 is formed as a connection chamber that connects the descending channel 84 and a liquid inlet 809 serving as the upstream end of the liquid supply portion 50 to be described later. This downstream end portion 852 includes the downstream end 85 to which the liquid inlet 809 is connected. It is preferred that, in the mounted state, the downstream end portion 852 is inclined upward relative to the horizontal direction toward the liquid supply portion 50, in other words, toward the downstream end 85. In addition, it is more preferable that the inclination of the downstream end portion 852 is an inclination having an angle of 10° or more and 45° or smaller relative to the horizontal direction. In this embodiment, the inclination of the downstream end portion 852 has an angle of 15° relative to the horizontal direction. Here, the angle of inclination of the downstream end portion 852 is an angle formed by the bottom face of the downstream end portion 852 and the horizontal direction (this angle is an acute angle). In the case where the downstream end portion 852 is inclined as described above, it is possible to suppress the flow of air bubbles remaining in the liquid supply portion 50 into the liquid communication channel 80. Therefore, it is possible to suppress blockage of the liquid communication channel 80 with air bubbles.

The air communication channel 70 (FIG. 8) has the connection portion 72 for air that forms one end thereof, an air first channel 76 serving as an upward air channel, the air second channel 73 serving as an inclined air channel, an air third channel 74, and a connection portion 75 on the supply side that forms the other end of the air communication channel 70. In the mounted state, the air communication channel 70 is connected to the first liquid chamber 51 at a position higher than the upstream end 82 that is at a connection position between the liquid communication channel 80 and the first liquid chamber 51.

The connection portion 72 for air is an opening formed in the uppermost portion 519 in the peripheral wall 518. Accordingly, the air communication channel 70 is connected to the uppermost portion 519 of the first liquid chamber 51 in the mounted state. It is preferred that, in the mounted state, the connection portion 72 for air is formed at the same height as the uppermost portion 861 for liquid of the liquid communication channel 80 or at a position higher than the uppermost portion 861 for liquid. In this case, in the first liquid chamber 51, the volume of the uppermost portion 519 can be set to be large, compared with the case where the connection portion 72 for air is formed at a position lower than the uppermost portion 861 for liquid. In this embodiment, the connection portion 72 for air is formed at a position higher than the uppermost portion 861 for liquid.

In the mounted state, the air first channel 76 has the connection portion 72 for air at one end thereof, and extends upward from the first liquid chamber 51. The air second channel 73 connects the air first channel 76 and the air third channel 74, and, in the mounted state, extends in a direction including the horizontal direction components (in this embodiment, the X axis direction). The air third channel 74 extends downward from the air second channel 73, in the mounted state. The air third channel 74 is connected to the liquid supply portion 50 via the connection portion 75 on the supply side. The connection portion 75 on the supply side is formed as a connection chamber that connects the air third channel 74 and the liquid inlet 809.

It is preferred that the air second channel 73 is a channel extending in a direction inclined relative to the horizontal direction, in the mounted state. It is more preferred that the air second channel 73 is inclined with an angle of 10° or more and 45° or smaller relative to the horizontal direction. Here, an angle that is formed by the air second channel 73 and the horizontal direction is an angle formed by the bottom face of the air second channel 73 and the horizontal direction (this angle is an acute angle). Due to the air second channel 73 extending in a direction inclined relative to the horizontal direction, when liquid flows into the air second channel 73, liquid that has flowed into the air second channel 73 is likely to flow from the air second channel 73 to the air first channel 76 or the air third channel 74, compared with the case where the air second channel 73 extends in the horizontal direction. Therefore, it is possible to prevent the liquid that has flowed into the air second channel 73 from remaining in the air second channel 73. Therefore, it is possible to suppress blockage of the air second channel 73 with the liquid that has flowed into the air second channel 73. Note that the flow of liquid into the air second channel 73 is caused by a change in the temperature or air pressure, or inversion or vibration of the liquid tank 30, for example. In this embodiment, the entire air second channel 73 is inclined downward toward the air third channel 74, in the mounted state, and forms an angle of 15° with the horizontal direction.

It is more preferred that the connection portion 75 on the supply side that is the downstream end of the air communication channel 70 is, in the mounted state, positioned immediately above the liquid inlet 809 of the liquid supply portion 50, which will be described later. "Positioned immediately above" refers to an arrangement in which the connection portion 75 on the supply side overlaps at least a portion of the liquid inlet 809 when viewed from the Z axis direction. It is more preferred that the connection portion 75 on the supply side and the liquid inlet 809 are arranged such that the center of the channel cross-section in the connection portion 75 on the supply side generally overlaps the center of the channel cross-section of the liquid inlet 809. In the case where the connection portion 75 on the supply side is positioned immediately above the liquid inlet 809, if air bubbles remaining in the liquid supply portion 50 move upward, the air bubbles are likely to flow into the air communication channel 70 compared with the case where the connection portion 75 on the supply side is not positioned immediately above the liquid inlet 809. Accordingly, air bubbles remaining in the liquid supply portion 50 are kept from flowing into the liquid communication channel 80. In this embodiment, the connection portion 75 on the supply side is positioned immediately above the liquid inlet 809.

The liquid supply portion 50 (FIG. 7) is positioned below the downstream end 85 in the mounted state. Also, the liquid supply portion 50 extends downward toward the liquid supply port 505, in the mounted state. In this embodiment, in the mounted state, the liquid supply portion 50 extends in the vertically downward direction toward the liquid supply port 505, but in another embodiment, the liquid supply portion 50 may obliquely extend as long as downward components are included.

The liquid supply portion 50 (FIG. 8) has the liquid inlet 809, a first supply portion 501, and a second supply portion 502. The liquid inlet 809 forms the upstream end of the liquid supply portion 50 in the flow direction of liquid. The liquid inlet 809 is open in the vertically upward direction in the mounted state. The first supply portion 501 is provided with an internal channel connected to the liquid inlet 809. The first supply portion 501 is formed inside the tank body 40. The second supply portion 502 is connected to the first supply portion 501. The second supply portion 502 is formed by a member protruding vertically downward from the lower face 402, in the mounted state. The second supply portion 502 has the liquid supply port 505. The liquid supply port 505 is open in the vertically downward direction in the mounted state.

As shown in FIG. 8, when the liquid tank 30 is viewed from one side (the −Y axis direction side) of the one side wall 408, the liquid injection portion 42 and the liquid supply port 505 are arranged at diagonal positions. For example, when the liquid tank 30 is viewed from one side (the −Y axis direction side) of the one side wall 408, the liquid injection portion 42 is positioned on the vertically upward side relative to the first liquid chamber 51 in the mounted state and on one side (the +X axis direction side) of the horizontal direction (e.g., the X axis direction) relative to the inlet opening portion 547 of the first liquid chamber 51. In addition, when the liquid tank 30 is viewed from one side (the −Y axis direction side) of the one side wall 408, the liquid supply port 505 is positioned on the vertically downward side relative to the first liquid chamber 51 in the mounted state and on the other side (the −X axis direction side) in the horizontal direction (e.g., the X axis direction) relative to the inlet opening portion 547 of the first liquid chamber 51. Accordingly, it is possible to prevent the distance from the liquid injection portion 42 to the liquid supply port 505 from being short, and thus, even in the case where air bubbles are generated when liquid is injected from the liquid injection portion 42 into the second liquid chamber 52, it is possible to reduce the likelihood of air bubbles reaching the liquid supply port 505. Accordingly, it is possible to reduce air bubbles remaining in the vicinity of the liquid supply port 505 in the liquid supply portion 50, and thus it is possible to reduce the likelihood of air bubbles flowing into the liquid ejection head 12. In addition, it is possible to efficiently arrange channels that run from the liquid injection portion 42 to the liquid supply port 505, and through which liquid flows, and thus an increase in the size of the liquid tank 30 can be suppressed.

Next, the atmospheric air communication portion 300 will be described with reference to FIGS. 9 and 10A. The "upstream side" and "downstream side" used in the description of the atmospheric air communication portion 300 are based on the flow direction of fluid (air) that moves from the outside toward the second liquid chamber 52.

The atmospheric air communication portion 300 includes the atmospheric air release portion 44 serving as an upstream end thereof, a first atmospheric air channel 302 (FIG. 9), a second atmospheric air channel 304 (FIG. 9), a meandering channel 306 (FIG. 9), a gas-liquid separation chamber 308 (FIG. 9), a buffer chamber 310 (FIG. 10A), an atmospheric air intermediate channel 372 (FIG. 9), and an atmospheric air introduction portion 340 serving as the downstream end of the atmospheric air communication portion 300, from the upstream side in the stated order. Here, in the atmospheric air communication portion 300, various channels formed on one side (the −Y axis direction side) of the one side wall 408 are demarcated by the tank body 40 and the first film 91 (FIG. 4), and various channels formed on the other side (the +Y axis direction side) of the one side wall 408 are demarcated by the tank body 40 and the third film 93 (FIG. 4). The buffer chamber 310 includes a first buffer chamber 312, a second buffer chamber 314, a third buffer chamber 316, a fourth buffer chamber 318, and a fifth buffer chamber 319 from the upstream side in the stated order.

The atmospheric air release portion 44 (FIG. 9) is a cylindrical member extending in the +Z axis direction from a portion of the upper face 401 on the rear face 403 side. The first atmospheric air channel 302 (FIG. 9) is a channel that connects the atmospheric air release portion 44 and the second atmospheric air channel 304. The second atmospheric air channel 304 is a long and thin channel extending along the X axis direction. The meandering channel 306 is a channel that connects the second atmospheric air channel 304 and the gas-liquid separation chamber 308. The meandering channel 306 is a channel that is long, thin, and meanders such that the channel length of the atmospheric air communication portion 300 is increased. Accordingly, it is possible to suppress the evaporation of moisture in the liquid in the second liquid chamber 52. A gas-liquid separation film (not illustrated) is arranged in an inner peripheral wall 307 of the gas-liquid separation chamber 308. The gas-liquid separation film is made of a material that allows the permeation of gas, and does not allow the permeation of a liquid. The downstream end of the gas-liquid separation chamber 308 is a through hole 331 that penetrates the one side wall 408. The gas-liquid separation chamber 308 and the first buffer chamber 312 (FIG. 10A) are connected by the through hole 331. The first buffer chamber 312 is in communication with the second buffer chamber 314 via a gap between the third film 93 and the end face of the tank body 40 on the +Y axis direction side.

The second buffer chamber 314 and a first intermediate connection channel 341 (FIG. 8) are in communication with each other via a through hole 332 that penetrates the one side wall 408. The downstream end of the first intermediate connection channel 341 is a through hole 333 that penetrates the one side wall 408. The first intermediate connection channel 341 and the third buffer chamber 316 (FIG. 10A) are in communication with each other via the through hole 333. The third buffer chamber 316 and a second intermediate connection channel 344 are in communication with each other via a through hole 334 that penetrates the one side wall 408. The second intermediate connection channel 344 and the fourth buffer chamber 318 are in communication with each other via a through hole 335 that penetrates the one side wall 408. The fourth buffer chamber 318 and a third intermediate connection channel 371 are in communication with each other via a through hole 336 that penetrates the one side wall 408. The third intermediate connection channel 371 and the fifth buffer chamber 319 are in communication with each other via a through hole 337 that penetrates the one side wall 408 and a notch portion 338 formed in the periphery of the through hole 337. A bottom face 319*a* of the fifth buffer chamber 319 is inclined downward from the notch portion 338 that is on the upstream side toward a through hole 339 that is on the downstream side. Accordingly, even in the case where liquid intrudes into the fifth buffer chamber 319 from the through hole 339, it is possible to reduce the likelihood of a liquid reaching the notch portion 338.

The fifth buffer chamber 319 and the atmospheric air intermediate channel 372 are in communication with each other via the through hole 339 that penetrates the one side wall 408. The atmospheric air intermediate channel 372 and the second liquid chamber 52 are in communication with each other via the atmospheric air introduction portion 340 that penetrates the one side wall 408. The atmospheric air introduction portion 340 is arranged in the vicinity of the upper face of the second liquid chamber 52 in the mounted state.

A-4. Configuration of Valve Mechanism 60

Figure 11:
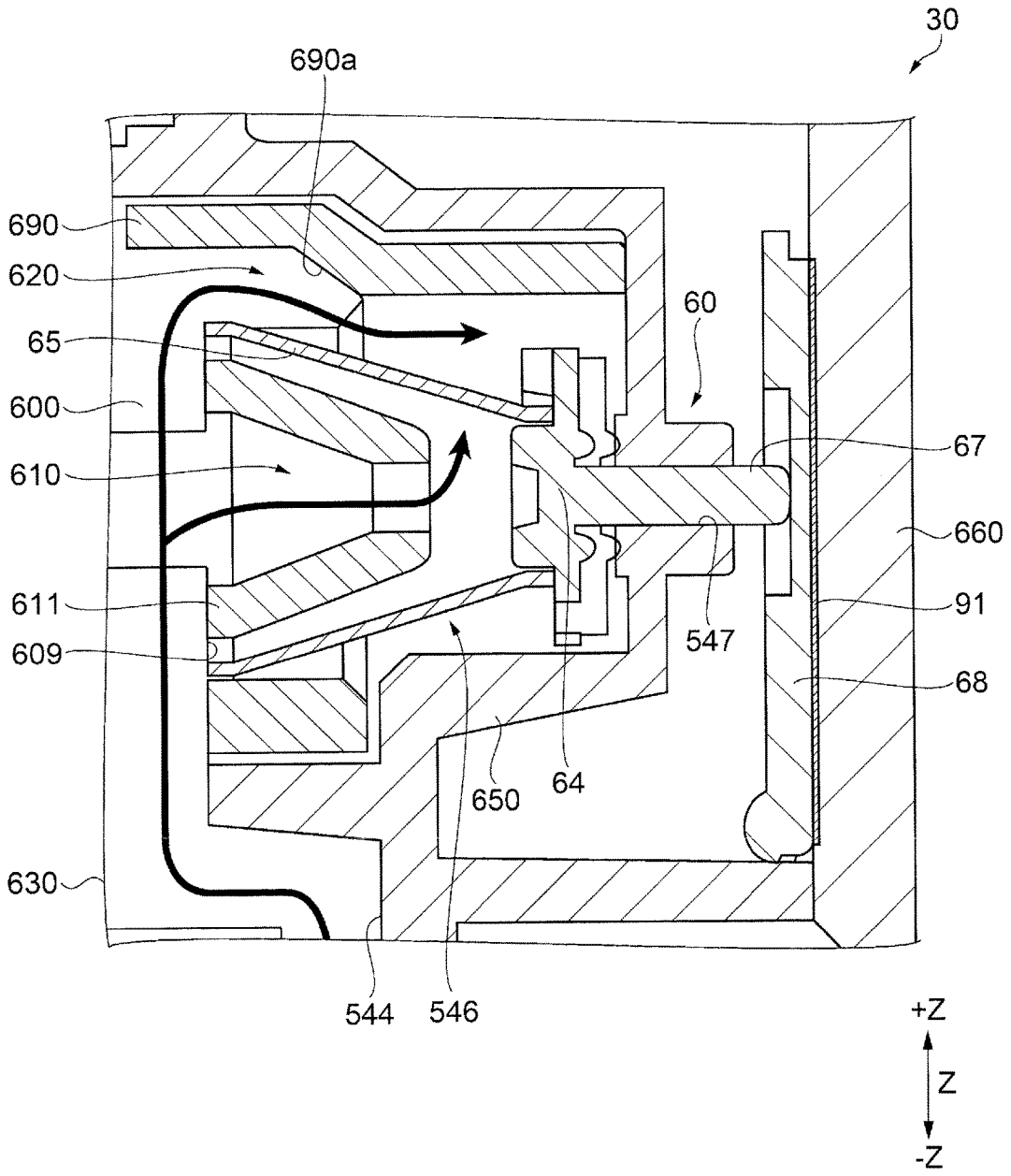
FIG. 11 is a schematic diagram showing the configuration of a valve mechanism.
Figure 12:
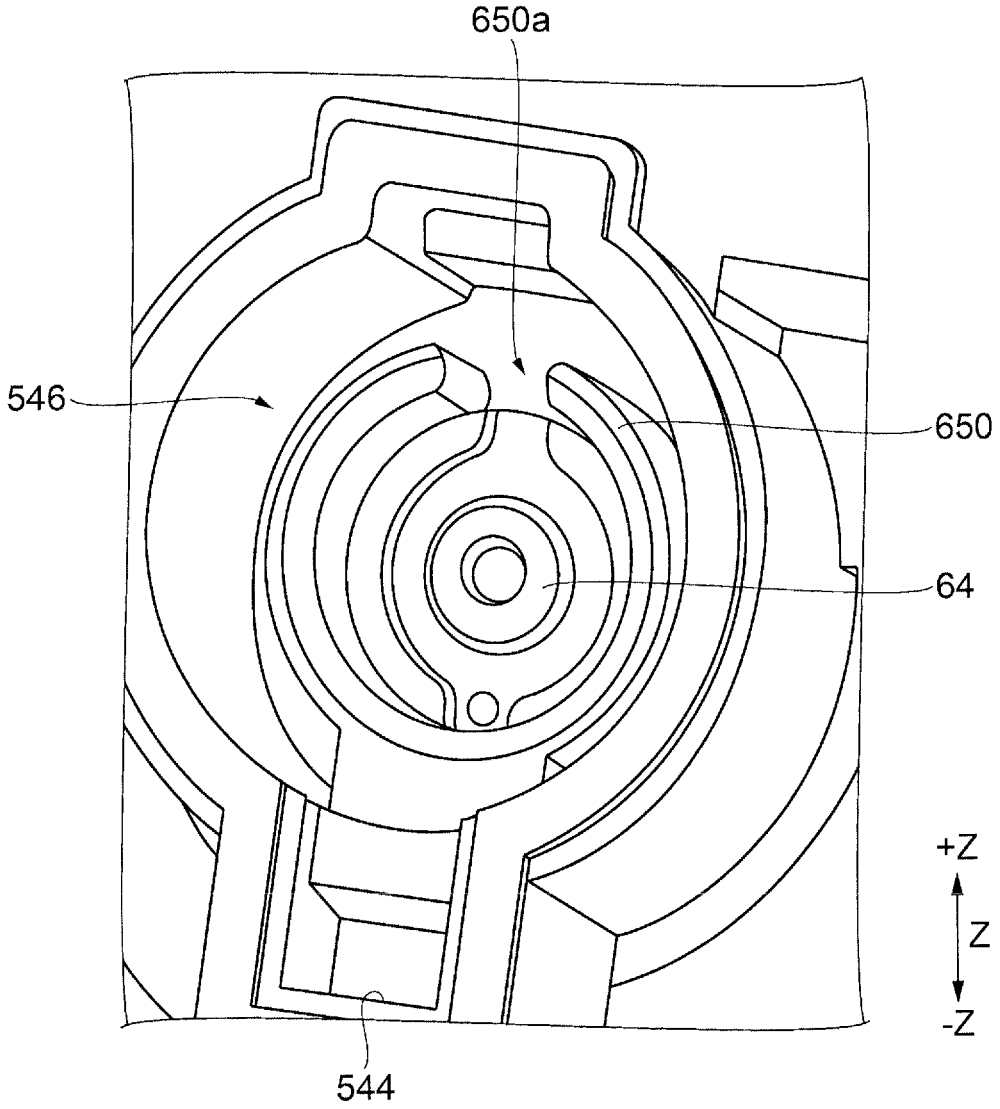
FIG. 12 is a schematic diagram showing the configuration of a valve mechanism.
Figure 13:
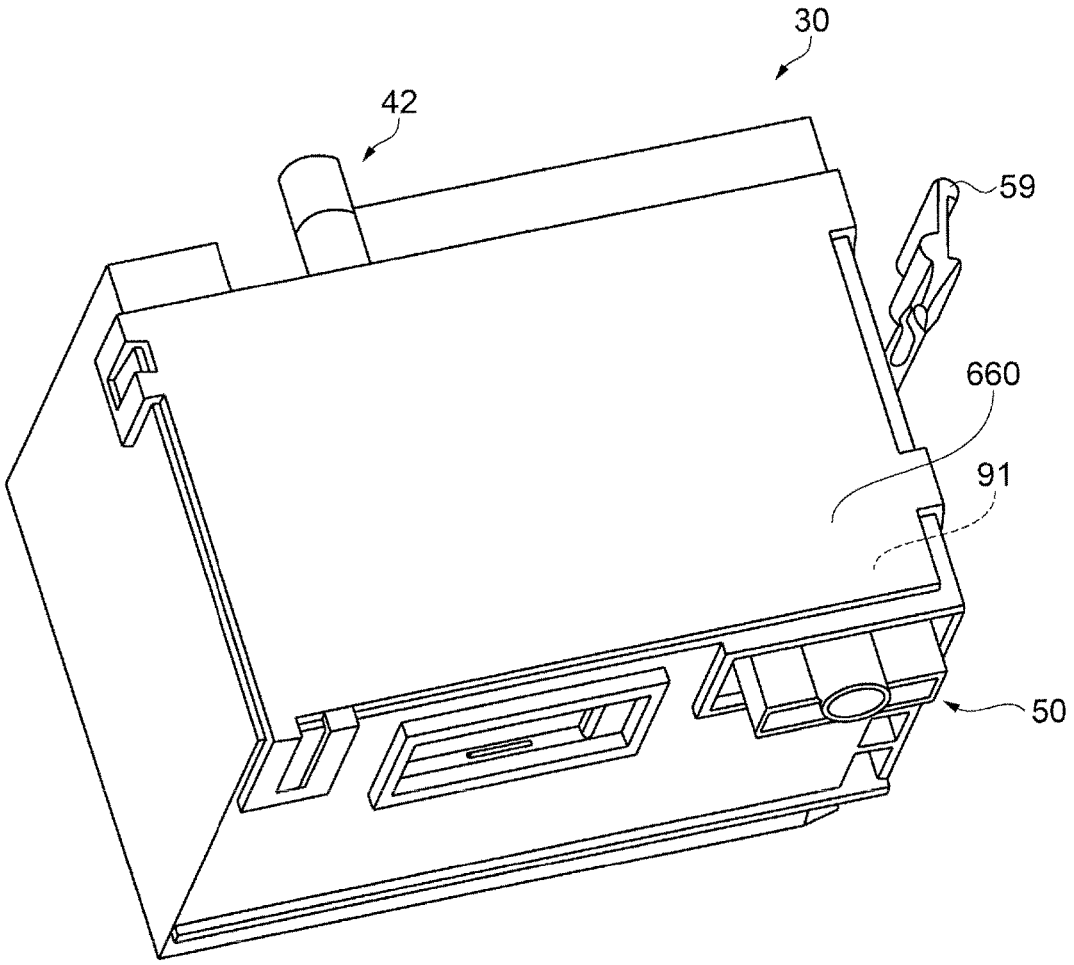
FIG. 13 a schematic diagram showing the configuration of a valve mechanism.

FIGS. 11 to 13 are schematic diagrams showing the configuration of a valve mechanism.

As shown in FIG. 11, the valve mechanism 60 has the channel member 600. The channel member 600 is a member for allowing liquid supplied from the intermediate channel 544 to flow into the valve-arranged chamber 546.

Also, the channel member 600 is provided inside the biasing member 65, and has the first channel 610 through which liquid can pass.

Specifically, the channel member 600 has a hollow cylindrical tube portion 611 through which liquid can flow. The tube portion 611 is arranged such that liquid passes from the upstream side of the flow of liquid to the valve body 64 on the downstream side. Accordingly, the tube portion 611 is arranged in a direction intersecting the Z axis. In addition, the inside of the tube portion 611 is demarcated as the first channel 610.

In addition, the second channel 620 that allows liquid to flow between the exterior wall 690 and the biasing member 65 is provided. The second channel 620 is arranged on the downstream side of the flow of liquid relative to the first channel 610. Therefore, liquid that is supplied from the intermediate channel 544 flows through the first channel 610 earlier than the second channel 620.

Moreover, a configuration is adopted in which the channel resistance of the second channel 620 is lower than the channel resistance of the first channel 610. Specifically, the inner diameter of the tube portion 611 in which the first channel 610 is formed is gradually narrowed from the upstream side to the downstream side of the flow of liquid. In other words, the first channel 610 gradually narrows from the upstream side to the downstream side of the flow of liquid.

On the other hand, the second channel 620 has a substantially constant space from the upstream side to the downstream side of the flow of liquid, unlike the shape of the first channel 610. Therefore, the channel resistance of the second channel 620 can be made lower than the channel resistance of the first channel 610. In other words, the flow of liquid in the first channel 610 is slower than that in the second channel 620.

Note that a portion of the channel member 600 of the liquid tank 30 is constituted by a film 630 serving as a demarcation portion. Specifically, the film 630 is attached on the upstream side of the flow of liquid in the channel member 600. Accordingly, it is possible to reliably demarcate the first channel 610 and the second channel 620. Accordingly, liquid that flows between the channel member 600 and the film 630 can flow to the first channel 610 and the second channel 620.

In addition, the tube portion 611 (corresponding to at least a portion of the channel member 600) has a shape that runs along the inner periphery of the biasing member 65. Here, the two ends of the biasing member 65 are respectively restricted by an end face 609 of the channel member 600 and the valve body 64. The biasing member 65 is arranged in a direction intersecting the Z axis, similar to the tube portion 611. In addition, the above-described end face 609 is arranged at substantially the same position as the end portion of the tube portion 611 on the upstream side of flow of liquid. In addition, the inner periphery (inner diameter) of the biasing member 65 gradually narrows from one end to the other. In other words, the inner periphery (inner diameter) of the biasing member 65 becomes narrower from the upstream side to the downstream side of the flow of liquid. Moreover, the tube portion 611 is arranged on the inner periphery side of the biasing member 65, and thus the outer periphery face of the tube portion 611 is arranged along the inner periphery of the biasing member 65. Therefore, liquid flows through the tube portion 611 arranged along the inner periphery of the biasing member 65, and thus the gap between the tube portion 611 and the biasing member 65 is narrowed, and it is possible to reduce the attachment of air bubbles to the biasing member 65.

In addition, at least a portion of the exterior wall 690 that forms the second channel 620 has a shape that runs along the outer periphery of the biasing member 65. Specifically, a face 690*a* that is a portion of the exterior wall 690 constituting the second channel 620, and is opposed to the biasing member 65 has an inclined face that is gradually inclined from the upstream side to the downstream side of the flow of liquid to the biasing member 65 side. Due to the face 690*a*, at least a portion of the exterior wall 690 that forms the second channel 620 has a shape that runs along the outer periphery of the biasing member 65. In this manner, by adopting a configuration in which a portion of the second channel 620 is formed along the outer periphery of the biasing member 65, the fluidity of liquid in the second channel 620 can be improved. Accordingly, air bubbles are prevented from gathering in the second channel 620. In addition, it is possible to prevent the attachment of air bubbles in the second channel 620, and the like, and efficiently allow liquid to flow.

Moreover, in a usage state, the second channel 620 is arranged above the first channel 610 in the vertical direction. Specifically, in a usage state in which the liquid tank 30 is mounted in the carriage 19, as shown in FIG. 11, the second channel 620 is arranged in the +Z axis direction relative to the first channel 610. Therefore, in a usage state of the liquid tank 30, it is easy to gather air bubbles to the second channel 620 side above the first channel 610. In addition, in the second channel 620, air bubbles can be easily discharged to the liquid ejection head 12 side along with flow of a liquid at a higher flow speed.

In addition, as shown in FIG. 12, a wall portion 650 that surrounds an outer periphery portion of the valve body 64 is formed. In addition, a notch portion is formed in a portion of the wall portion 650, and forms a communication portion 650*a* through which liquid can pass. Here, in a usage state, the communication portion 650*a* is provided above the valve body 64 in the vertical direction.

Note that FIG. 12 is a perspective view of the valve-arranged chamber 546 in which the channel member 600 and the biasing member 65 are omitted for ease of specific description.

Accordingly, liquid is discharged from the inlet opening portion 547 through the communication portion 650*a*. Accordingly, a path for liquid can be secured while filling a gap in the periphery of the valve body 64 constituting a portion of the valve mechanism 60 by forming the wall portion 650 such that air bubbles do not remain in the periphery of the valve body 64.

In addition, as shown in FIGS. 11 and 13, a tank cover 660 that covers the pressure receiving plate 68 so as to be capable of abutting against the first film 91 is provided. The tank cover 660 is shaped like a plate, and is made of various metal materials or a plastic material, for example. Note that a method for attaching the tank cover 660 is not particularly limited, and, for example, the tank cover 660 is attached to a wall of the liquid tank 30 using a screw or a hook, through adhesive attachment, or the like.

Depending on the arrangement of the tank cover 660 as well as a change in the environment in which the liquid tank is used (e.g., temperature and air pressure), a stable working pressure can be ensured. In addition, it is possible to prevent the first film 91 from separating and the like, and prevent liquid leakage.

A-5. Operation of Liquid Tank 30

In initial liquid filling, liquid is first injected from the liquid injection portion 42 (FIG. 5) into the second liquid chamber 52 (FIG. 6). Next, sucking (a discharging operation) of fluid (e.g., air or liquid) in the liquid tank 30 is started from the liquid ejection head 12 via the liquid supply portion 50. This suction is performed by driving the suction pump 16 of the discharge portion 18 (FIG. 2). If the pressure in the first liquid chamber 51 becomes a negative pressure due to this suction, the valve mechanism 60 enters an open state, and liquid in the second liquid chamber 52 flows into the first liquid chamber 51 via the inlet opening portion 547 (the valve-arranged chamber 546).

Note that initial liquid filling is performed in a state where the liquid tank 30 is mounted in the carriage 19. Accordingly, in a usage state of the liquid tank 30, initial liquid filling is performed. Therefore, in initial liquid filling, in the liquid tank 30, the second channel 620 is positioned above the first channel 610 in the vertical direction (the X axis direction) (see FIG. 11).

Here, a process in which liquid flows in the valve-arranged chamber 546 during initial filling will be described.

Liquid that has flowed from the intermediate channel 544 into the valve-arranged chamber 546 first flows through the first channel 610 provided in a lower portion in the vertical direction, and the valve-arranged chamber 546 is filled with liquid from its lower region in the vertical direction.

At this time, the liquid flows through the first channel 610, which is constituted by the tube portion 611, and the liquid flows in from a wide opening portion side of the tube portion 611, and is discharged to a narrow opening portion side of the tube portion 611, and thus the channel resistance is high, and the flow speed of the liquid decreases. Accordingly, a lower region in the vertical direction of the valve-arranged chamber 546 is filled with liquid relatively slowly. Furthermore, the tube portion 611 has a shape that runs along the inner periphery of the biasing member 65, and thus liquid is unlikely to directly flow between the outer periphery face of the tube portion 611 and the inner periphery portion of the biasing member 65. Accordingly, it is possible to prevent air bubbles included in the flowing liquid from attaching to the biasing member 65.

Note that, in a process in which the above-described valve-arranged chamber 546 is filled with liquid from its lower region in the vertical direction, the liquid does not flow out of the inlet opening portion 547. This is because the communication portion 650*a* provided in the wall portion 650 that surrounds the valve body 64 is arranged in an upper potion in the vertical direction.

Next, as liquid further flows into the valve-arranged chamber 546, the liquid level of the liquid in the Z axis direction of the valve-arranged chamber 546 rises.

The liquid then flows through the second channel 620 formed between the biasing member 65 and the exterior wall 690. The channel resistance of the second channel 620 is lower than the channel resistance of the first channel 610, and thus the flow speed of the liquid increases.

In addition, the second channel 620 is arranged in an upper portion in the Z axis direction of the valve-arranged chamber 546. Therefore, air bubbles that are caught up in the flow of liquid gather on the second channel 620 side. The liquid then passes through the second channel 620, and the liquid and the air bubbles are discharged from the communication portion 650*a*.

Here, in the second channel 620, the face 690*a* that is a portion of the exterior wall 690 has a shape that runs along the outer periphery of the biasing member 65, and thus air bubbles can be promptly discharged while preventing air bubbles from gathering in the second channel 620.

After that, the air bubbles discharged from the valve-arranged chamber 546 are discharged from the liquid ejection head 12 to the outside via the liquid supply portion 50.

In addition, in the liquid tank 30 after initial liquid filling, in the case where an operation (discharge operation) of regularly sucking out fluid (e.g., liquid or air) from the liquid ejection head 12 is executed by driving the discharge portion 18, the valve mechanism 60 enters an open state due to the pressure in the first liquid chamber 51 reaching a negative pressure, and liquid in the second liquid chamber 52 flows into the first liquid chamber 51 via the inlet opening portion 547. Note that, in this case, in a usage state of the liquid tank 30, the liquid level of liquid in the Z axis direction of the valve-arranged chamber 546 drops, but this is after the valve-arranged chamber 546 has been filled with liquid already, and thus liquid flows only to the inlet opening portion 547 via the second channel 620. Therefore, the first channel 610 and the biasing member 65 are filled with liquid, and thus the adherence of air bubbles to the biasing member 65 is unlikely to occur.

As described above, according to this embodiment, the following effects can be obtained.

By setting different channel resistances between the first channel 610 and the second channel 620, the flow speed of liquid in the second channel 620 can be made higher than the flow speed of liquid in the first channel 610. This allows liquid to flow at a relatively slow flow speed in the first channel 610 below the second channel 620 in the Z axis direction, in a usage state. Accordingly, it is possible to prevent air bubbles from attaching to the biasing member 65. In addition, in the second channel 620 above the first channel 610 in the Z axis direction, liquid is allowed to flow at a relatively high flow speed. Accordingly, air bubbles that have gathered in an upper portion in the Z axis direction can be efficiently discharged from the valve-arranged chamber 546. Accordingly, in an on-carriage-type liquid tank, it is possible to ensure that air bubbles are unlikely to remain in the valve mechanism 60, and air bubbles can be easily discharged from the liquid ejection head 12.

B. Other Embodiments

Note that the invention is not limited to the above working examples and embodiment, and can be carried out in various aspects without departing from the gist thereof, and, for example, the following modifications are possible.

B-1. First Other Embodiment

The invention is not limited to an inkjet printer and a liquid tank for supplying ink to an inkjet printer, and can also be applied to any liquid ejection apparatus that ejects liquid other than ink and a liquid tank for containing the liquid. For example, the invention can be applied to the following various liquid ejection apparatuses and liquid tanks thereof.

(1) Image recording apparatuses such as a facsimile apparatus, (2) Color material ejection apparatuses used to manufacture color filters for image display apparatuses such as a liquid crystal display, (3) Electrode material ejection apparatuses used to form electrodes for organic EL (Electro Luminescence) displays, surface light emission displays (field emission displays, FED), or the like.

(4) Liquid ejection apparatuses that eject liquid containing biological organic matter used to manufacture biochips, (5) Sample ejection apparatuses serving as precision pipettes, (6) Lubricating oil ejection apparatuses, (7) Resin liquid ejection apparatuses, (8) Liquid ejection apparatuses that perform pinpoint ejection of lubricating oil to precision machines such as a watch and a camera, (9) Liquid ejection apparatuses that eject transparent resin liquid such as UV-cured resin liquid onto substrates in order to form micro-hemispherical lenses (optical lenses) or the like used in optical communication elements or the like,

(10) Liquid ejection apparatuses that eject acid or alkaline etchant in order to etch substrates or the like, and

(11) Liquid ejection apparatuses that include liquid ejection heads for discharging a very small amount of any other kinds of droplet.

Note that "droplet" refers to a state of a liquid discharged from a liquid ejection apparatus, and includes droplets having a granular shape, a tear-drop shape, and a shape with a thread-like trailing end. In addition, the "liquid" mentioned here need only be a material, which can be ejected by a liquid ejection apparatus. For example, the "liquid" need only be a material in a state where a substance is in a liquid phase, and a liquid material having a high or low viscosity, sol, gel water, and other liquid materials such as an inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. In addition, representative examples of the liquid include ink such as that described in the above embodiment, liquid crystal, or the like. Here, the "ink" encompasses general water-based ink and oil-based ink, as well as various types of liquid compositions such as gel ink and hot melt ink.

This application claims the benefit of foreign priority to Japanese Patent Application No. JP2017-218830, filed Nov. 14, 2017, which is incorporated by reference in its entirety.

What is claimed is:

1. A liquid tank that is mounted in a carriage provided with a liquid ejection head, comprising:

a liquid supply portion having a liquid supply port that receives a liquid introduction needle portion of the liquid ejection head, and to which the liquid introduction needle portion is detachably connected;

a first liquid chamber that can contain the liquid to be supplied to the liquid supply portion;

a second liquid chamber that is in communication with the first liquid chamber, and can contain the liquid to be supplied to the first liquid chamber; and a valve mechanism that is arranged between the first liquid chamber and the second liquid chamber, wherein the valve mechanism has, inside an exterior wall constituting the valve mechanism, a channel member, a biasing member, a valve body, and a rod from an upstream side of flow of the liquid in the stated order, the channel member is provided inside the biasing member, and includes a first channel through which the liquid can pass, and the exterior wall and the biasing member form a second channel through which the liquid can pass therebetween.

2. The liquid tank according to claim 1 being configured such that a channel resistance of the second channel is lower than a channel resistance of the first channel.

3. The liquid tank according to claim 1, wherein the second channel is arranged downstream of the first channel.

4. The liquid tank according to claim 1, wherein, in a usage state, the second channel is arranged above the first channel in a vertical direction.

5. The liquid tank according to claim 1, wherein at least a portion of the channel member has a shape that runs along an inner periphery of the biasing member.

6. The liquid tank according to claim 1, wherein at least a portion of the exterior wall that forms the second channel has a shape that runs along an outer periphery of the biasing member.

7. The liquid tank according to claim 1, wherein at least of a portion of the channel member that receives one end of the biasing member is made of a film.

8. The liquid tank according to claim 1, wherein, in a wall portion that encloses the valve body in a usage state, a communication portion through which the liquid can pass is provided on an upper side in the vertical direction.

9. The liquid tank according to claim 1, further comprising:

a pressure receiving plate capable of abutting against one end of the rod with the valve body provided at the other end thereof;

a first film that covers the pressure receiving plate so as to be capable of abutting against the pressure receiving plate; and a tank cover that covers the pressure receiving plate so as to be capable of abutting against the first film.

* * * * *